US012246904B2

(12) United States Patent
Morita et al.

(10) Patent No.: US 12,246,904 B2
(45) Date of Patent: Mar. 11, 2025

(54) POUCH

(71) Applicant: TOPPAN INC., Tokyo (JP)

(72) Inventors: Saho Morita, Tokyo (JP); Takahiro Shimono, Tokyo (JP)

(73) Assignee: TOPPAN INC., Tokyo (JP)

( * ) Notice: Subject to any disclaimer, the term of this patent is extended or adjusted under 35 U.S.C. 154(b) by 122 days.

(21) Appl. No.: 17/916,881

(22) PCT Filed: Apr. 8, 2021

(86) PCT No.: PCT/JP2021/014934
§ 371 (c)(1),
(2) Date: Oct. 4, 2022

(87) PCT Pub. No.: WO2021/206150
PCT Pub. Date: Oct. 14, 2021

(65) Prior Publication Data

US 2023/0166900 A1 Jun. 1, 2023

(30) Foreign Application Priority Data

Apr. 8, 2020 (JP) ..... 2020-070005
Apr. 13, 2020 (JP) ..... 2020-071559

(51) Int. Cl.
*B65D 81/34* (2006.01)
*B65D 33/01* (2006.01)
*B65D 75/00* (2006.01)

(52) U.S. Cl.
CPC ..... *B65D 81/3461* (2013.01); *B65D 33/01* (2013.01); *B65D 75/008* (2013.01)

(58) Field of Classification Search
CPC ... B65D 81/3461; B65D 33/01; B65D 75/008
(Continued)

(56) References Cited

U.S. PATENT DOCUMENTS

2020/0198841 A1* 6/2020 Tanaka ..... C08L 67/04

FOREIGN PATENT DOCUMENTS

| | | |
|---|---|---|
| JP | 2000-191056 | 7/2000 |
| JP | 2006-327590 A | 12/2006 |
| JP | 2013-067393 | 4/2013 |
| JP | 2013-256323 A | 12/2013 |
| JP | 2014-015238 | 1/2014 |

(Continued)

OTHER PUBLICATIONS

Machine translation of JP 2013-256323 A (Year: 2013).*

(Continued)

*Primary Examiner* — Jes F Pascua
(74) *Attorney, Agent, or Firm* — STAAS & HALSEY LLP

(57) ABSTRACT

A pouch according to an embodiment is a pouch having an accommodation space that accommodates contents, and including a pair of sheets, and a pair of side seal portions sealed to form the accommodation space, wherein at least one of the pair of side seal portions includes a first seal portion located near the top portion, a second seal portion located near the bottom portion and separated from the first seal portion, and a steam discharge seal portion configured to connect the first and second seal portions, to protrude to the accommodation space side, and to release steam, a portion formed by a first region between the first and second seal portions and a second region surrounded by the first region and the steam discharge seal portion is an unsealed region, and a penetration portion that passes through at least one sheet in a thickness direction is formed in the unsealed region of the at least one sheet.

16 Claims, 12 Drawing Sheets

(58) Field of Classification Search
USPC ..... 383/100, 103
See application file for complete search history.

(56) References Cited

FOREIGN PATENT DOCUMENTS

| | | | | |
|---|---|---|---|---|
| JP | 2016-043543 | | | 4/2016 |
| JP | 2017-024745 | | | 2/2017 |
| JP | 2017057008 | A | * | 3/2017 |
| JP | 2017-222369 | | | 12/2017 |
| JP | 2018-127257 | A | | 8/2018 |
| JP | 2019-014539 | A | | 1/2019 |
| JP | 2019-199259 | | | 11/2019 |
| JP | 2020-037450 | | | 3/2020 |
| KR | 20160037499 | A | * | 4/2016 |
| KR | 20200007755 | A | * | 1/2020 |
| WO | WO 2010/122116 | A1 | | 10/2010 |
| WO | WO 2013/100058 | A1 | | 7/2013 |

OTHER PUBLICATIONS

Machine translation of JP 2018-127257 A (Year: 2018).*
Machine translation of JP2020037450A. (Year: 2020).*
International Search Report (Form PCT/ISA/210); mailed May 18, 2021 in corresponding PCT Application No. PCT/JP2021/014934 (2 pages) (4 pages English Translation).
Written Opinion (Form PCT/ISA/237); mailed May 18, 2021 in corresponding PCT Application No. PCT/JP2021/014934 (5 pages).
Written Opinion (Form PCT/ISA/237); mailed May 18, 2021 in corresponding PCT Application No. PCT/JP2021/014934 (5 pages) (6 pages English Translation).
Notification of Transmittal of Copies of Translation of the International Preliminary Report on Patentability (Form PCT/IB/338); mailed Oct. 20, 2022 in corresponding PCT Application No. PCT/JP2021/014934 (1 page).
International Preliminary Report on Patentability (Form PCT/IB/373); mailed Oct. 6, 2022 in corresponding PCT Application No. PCT/JP2021/014934 (1 page).
Japanese Office Action issued in counterpart Japanese Application No. 2020-071559 dated Oct. 24, 2023.
Japanese Office Action issued in counterpart Japanese Application No. 2020-070005 dated Oct. 24, 2023.
Partial Supplementary European Search Report issued in counterpart European Application 21783703.8 dated Apr. 26, 2024.
Japanese Office Action issued in counterpart Japanese Application No. 2020-070005 dated Jul. 2, 2024.

* cited by examiner

POUCH

CROSS REFERENCE TO RELATED APPLICATIONS

This application is a U.S. national stage of International Application No. PCT/JP2021/014934, filed on Apr. 8, 2021, which claims the priority benefit of Japanese Application No. 2020-070005, filed on Apr. 8, 2020 and Japanese Patent Application No. 2020-071559, filed on Apr. 13, 2020. The International Application and both of the Japanese Applications are incorporated by reference herein in their entirety.

TECHNICAL FIELD

The present invention relates to a pouch.

BACKGROUND ART

A pouch described in Patent Literature 1 is known as a pouch for accommodating contents (for example, food) and heating the contents. The pouch described in Patent Literature 1 has a structure for releasing steam generated when the contents are heated. Specifically, a seal portion of a side portion (a side seal portion) of the pouch has a protruding portion that protrudes to the accommodation space side. The inside of the protruding portion is an unsealed region. When the contents are heated and steam is generated, a seal on the protruding portion peels off. Thus, the space that accommodates the contents and the unsealed region are connected, and steam is discharged from the unsealed region using the unsealed region as a steam vent. As a pouch capable of releasing steam, for example, a pouch for a microwave oven described in Patent Literature 2 is also known.

CITATION LIST

Patent Literature

[Patent Literature 1] Japanese Unexamined Patent Publication No. 2019-14539

[Patent Literature 2] Japanese Unexamined Patent Publication No. 2018-127257

SUMMARY OF INVENTION

Technical Problem

When a pouch is heated in a convenience store or the like, for example, the pouch may be heated by a high power (for example, 1000 W or more) microwave oven using a commercial microwave oven. When the pouch is heated under a high power in this way, the contents are rapidly heated, and thus an internal pressure of the accommodation space increases at a high speed. Therefore, as described in Patent Literature 1, even when the protruding portion for releasing steam is provided, the pouch also expands rapidly as the internal pressure increases sharply, and thus the unsealed region may be blocked. When the unsealed region is blocked, steam cannot be released, thus the pouch may burst or seals other than the seal portion for releasing steam may be peeled off, and the contents may pop out from the pouch.

Therefore, an object of the present invention is to provide a pouch capable of safely heating contents even under a high power (for example, 1000 W or more).

Solution to Problem

A pouch according to the present invention is a pouch having an accommodation space that accommodates contents between a bottom portion and a top portion on a side opposite to the bottom portion, including a pair of sheets that are aligned one over another, and a pair of side seal portions provided on both sides of the pair of sheets to be sealed so that the pair of sheets form the accommodation space, wherein at least one of the pair of side seal portions includes a first seal portion located closer to the top portion, a second seal portion located closer to the bottom portion than the first seal portion and separated from the first seal portion, and a steam discharge seal portion configured to connect the first seal portion and the second seal portion, to protrude to the accommodation space side, and to release steam, a portion formed by a first region between the first seal portion and the second seal portion and a second region surrounded by the first region and the steam discharge seal portion is a steam discharge region for allowing passage of steam, and a penetration portion that passes through at least one of the pair of sheets in a thickness direction is formed in the steam discharge region of the at least one sheet.

In the pouch having such a configuration, an unsealed region has the penetration portion. In this case, for example, even when an internal pressure of the pouch rapidly increases due to the pouch being heated at a high power, the penetration portion functions as a steam vent for releasing steam. Therefore, the pouch can be safely heated even under a high power.

The penetration portion may be formed in both of the pair of sheets. In this case, even when the pouch is heated under a high power, steam is more likely to be released.

At least a part of the penetration portion may be located closer to the accommodation space than a first virtual line obtained by virtually extending an edge portion located closest to the accommodation space side among the first seal portion and the second seal portion. In this case, it is possible to prevent bending of the first seal portion, the second seal portion, and the like.

A shape of the penetration portion when seen in the thickness direction may be an arc shape curved toward a center of the accommodation space. In this case, it is easy to release steam from the penetration portion.

The steam discharge seal portion may have a tip end portion at a position closest to a center side of the accommodation space in the steam discharge seal portion, and the penetration portion may be located on a second virtual line that connects a center of the accommodation space and the tip end portion. In this case, it is easy to release steam from the penetration portion.

A portion of the penetration portion closest to the center side of the accommodation space may be located on the second virtual line.

A pouch according to an embodiment may include a first bottom seal portion, and a second bottom seal portion. The bottom portion may have a bottom sheet interposed between the pair of sheets and being folded in a V-shape in a side view. One of the pair of side seal portions may be a left side seal portion, and the other one is a right side seal portion, and the left side seal portion and the right side seal portion may be substantially linear and may include a portion that joins the pair of sheets and a portion that joins facing surfaces of the folded bottom sheet. The first bottom seal portion may be a portion that joins a first sheet of the pair of sheets and the bottom sheet, and the first bottom seal portion may include a first left bottom seal portion, a first right bottom seal portion, and a substantially linear first bottom intermediate seal portion continuously connected to the first left bottom side seal portion and the first right bottom side seal portion between the first left bottom side seal portion and the first right bottom side seal portion. The second bottom seal portion may be a portion that joins a second sheet of the pair of sheets and the bottom sheet, and the second bottom seal portion may include a second left bottom seal portion, a second right bottom seal portion, and a substantially linear second bottom intermediate seal portion continuously connected to the second left bottom side seal portion and the second right bottom side seal portion between the second left bottom side seal portion and the second right bottom side seal portion.

When A1 [mm] is a length in a width direction from a lower end of an inner edge of a portion of the left side seal portion that joins facing surfaces of the folded bottom sheet, to a virtual vertical line with respect to an outer edge of the first bottom intermediate seal portion or the second bottom intermediate seal portion that includes a portion in which an inner edge of the first left bottom side seal portion or the second left bottom side seal portion continuously connected to the left side seal portion and an inner edge of the first bottom intermediate seal portion or the second bottom intermediate seal portion continuously connected to the first left bottom side seal portion or the second left bottom side seal portion intersect each other, and A2 [mm] is a length in the width direction from a lower end of an inner edge of a portion of the right side seal portion that joins the facing surfaces of the folded bottom sheet to a virtual vertical line with respect to the outer edge of the first bottom intermediate seal portion or the second bottom intermediate seal portion that includes a portion in which an inner edge of the first right bottom side seal portion or the second right bottom side seal portion continuously connected to the right side seal portion and the inner edge of the first bottom intermediate seal portion or the second bottom intermediate seal portion continuously connected to the first right bottom side seal portion or the second right bottom side seal portion intersect each other, the A1 and the A2 may be equal.

When B is a length of the inner edge of the first bottom intermediate seal portion or the second bottom intermediate seal portion in the width direction, a ratio of A1 to B to A2 may be 1:1:1 to 1:3:1.

In the above-described configuration, an opening property is improved by enhancing a bottom spreading property. Therefore, after opening the pouch after heat treatment in a microwave oven or the like, it is easy to eat food as it is from a steam dischargeable pouch.

When C [mm] is a length in a height direction from the folded portion of the bottom sheet to the lower end of the bottom sheet, and D [mm] is a length of the first bottom intermediate seal portion or the second bottom intermediate seal portion having a substantially linear shape in the height direction, the A1, the B, the A2, the C, and the D may satisfy Equation (1).

$$(A1+B+A2)\times 2 \geq (C-D)\times 3.14\times 2 \quad (1)$$

A length of the left side seal portion in the width direction and a length of the right side seal portion in the width direction may be equal.

An opening guide portion may be formed in a part of the left side seal portion or the right side seal portion. The opening guide portion may be provided between the steam discharge seal portion and the folded portion of the bottom sheet.

In the form in which the opening guide portion is formed in a part of the left side seal portion or the right side seal portion, when F [mm] is a length from the opening guide portion to the lower end of the bottom sheet in the height direction, the C and the F may satisfy Equation (2).

$$C\times 2 \leq F \quad (2)$$

The steam discharge region may be an unsealed region.

Advantageous Effects of Invention

According to the present invention, it is possible to provide a pouch capable of safely heating contents even under a high power.

DESCRIPTION OF EMBODIMENTS

Figure 1:
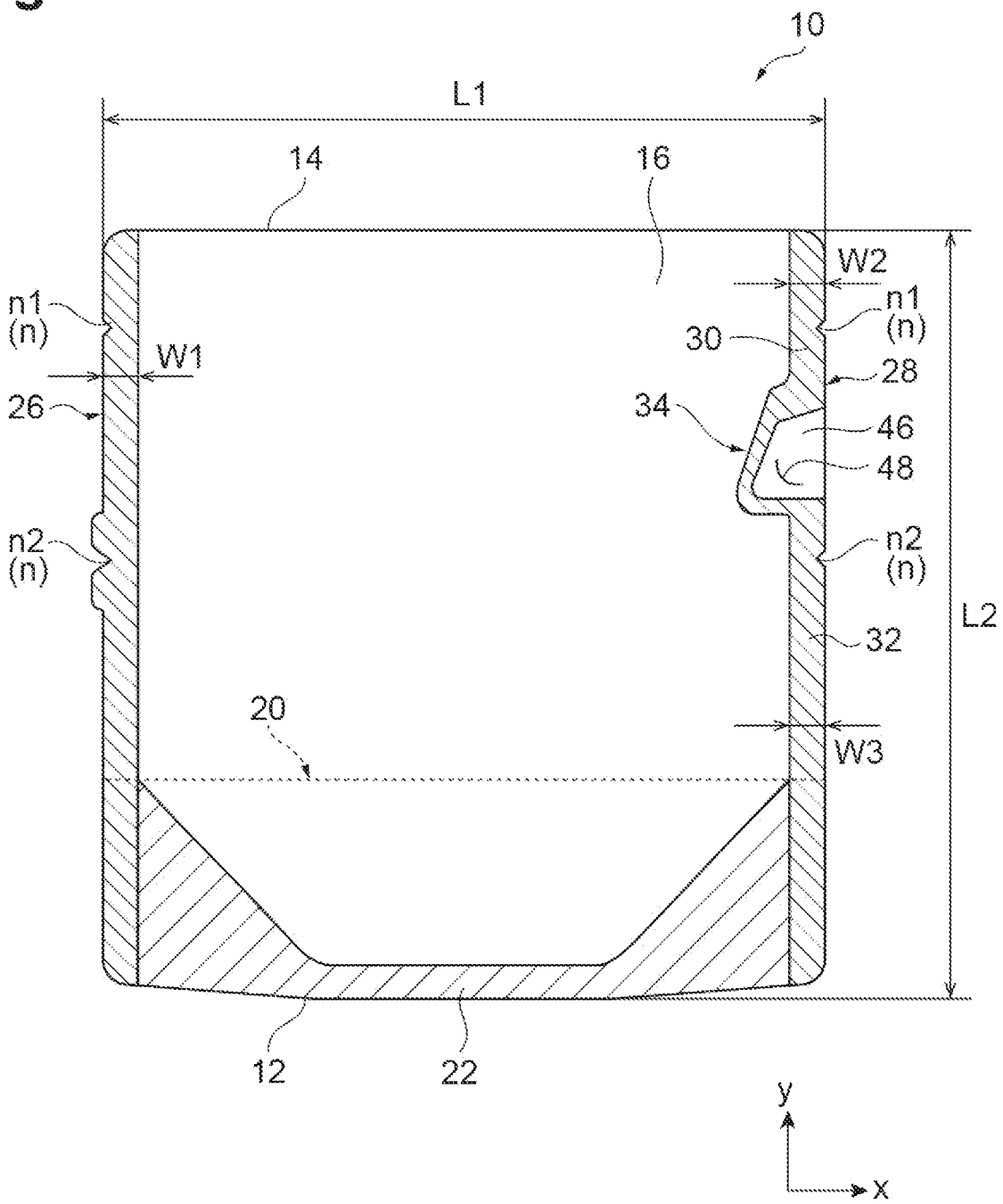
FIG. 1 is a schematic diagram of an example of a pouch according to an embodiment in a state in which a top portion is open.

Hereinafter, embodiments of the present invention will be described with reference to the drawings. The same elements are designated by the same reference numeral. Duplicate explanations thereof will be omitted. The dimensional ratios in the drawings do not always match those described.

First Embodiment

Figure 2:
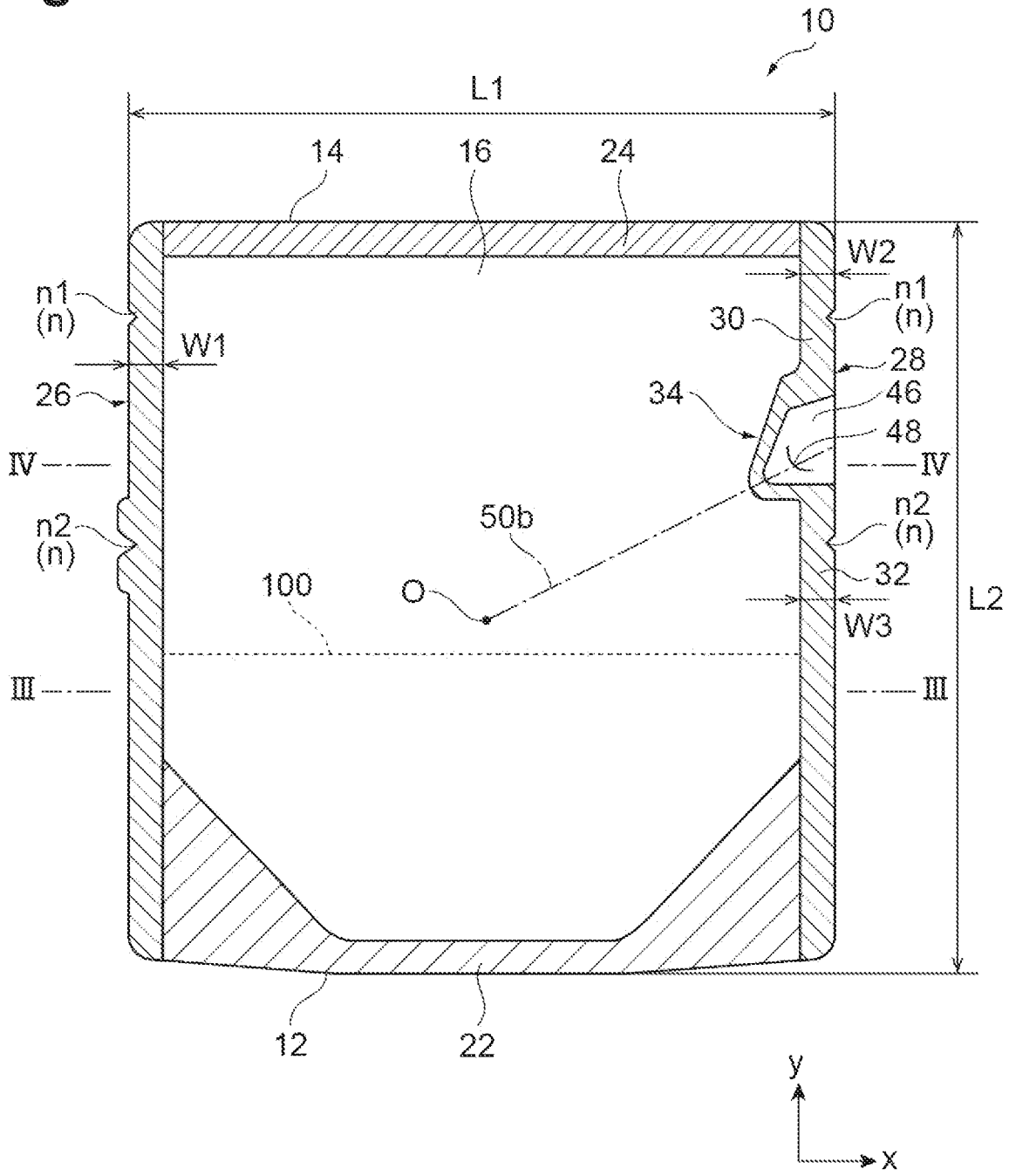
FIG. 2 is a diagram schematically showing the pouch shown in FIG. 1 in a state in which the top portion is closed.
Figure 3:
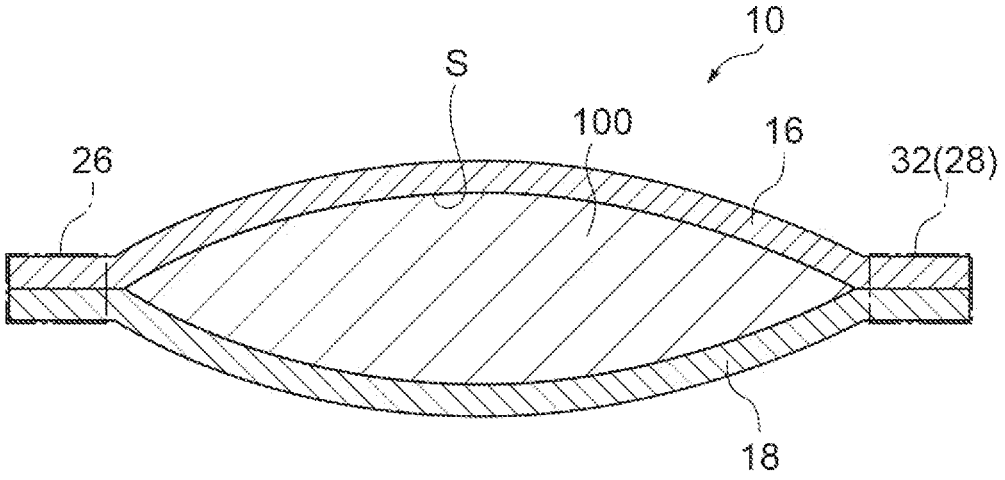
FIG. 3 is an end view along line III-III of FIG. 2.
Figure 4:
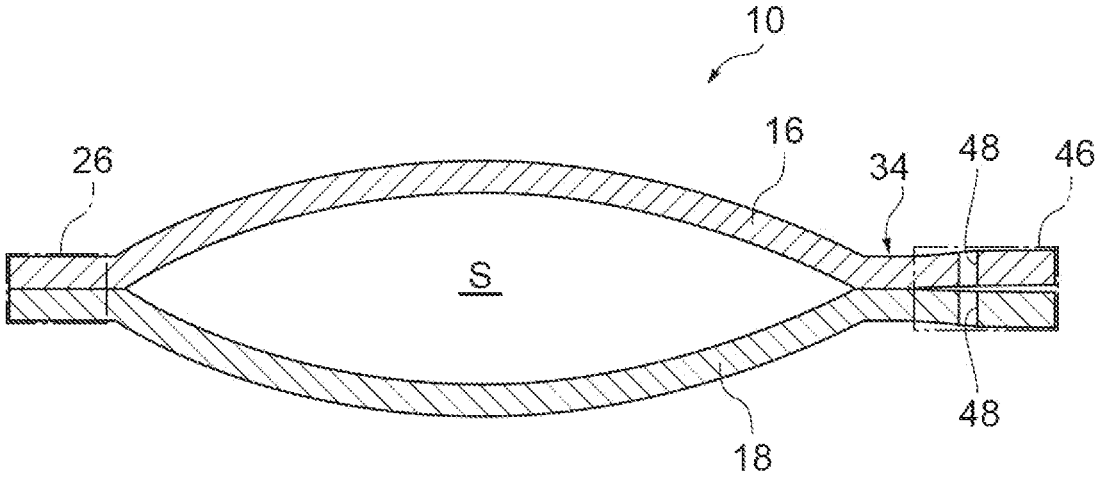
FIG. 4 is an end view along line IV-IV of FIG. 2.

FIG. 1 is a schematic diagram of an example of a pouch 10 according to an embodiment in a state in which a top portion is open. FIG. 2 is a drawing schematically showing the pouch 10 shown in FIG. 1 in a state in which the top portion is closed. FIG. 3 is an end view along line III-III of FIG. 2. FIG. 4 is an end view along line IV-IV of FIG. 2.

A pouch 10 has an accommodation space S (refer to FIGS. 3 and 4) for accommodating contents 200 between a bottom portion 12 and a top portion 14 located on the side opposite to the bottom portion 12. The pouch 10 is a self-standing packaging bag known as a standing pouch. Hereinafter, a state in which the top portion 14 is open to allow the contents 200 to be accommodated therein is referred to as an open state, and a state in which the top portion 14 is closed is referred to as a closed state. The pouch 10 in the closed state is a pouch 10 provided to an end user.

The contents 200 are, for example, food. The contents 200 are, for example, fluid food (for example, curry, hamburger, stew, soup, and the like). The pouch 10 is a packaging bag for cooking the contents 200 by heating the contents 200, for example, in a microwave oven. The pouch 10 is suitably used when the pouch 10 is heated by, for example, a high power band of 1000 W or more.

Hereinafter, for convenience of explanation, a direction orthogonal to an outer edge (a bottom side) of the bottom portion 12 of the pouch 10 or an outer edge (a top) of the top portion 14 may be referred to as a y direction, and a direction orthogonal to the y direction may also be referred to as an x direction (or a width direction). In the pouch 10, the bottom portion 12 side may be referred to as the lower side, and the top portion 14 side may be referred to as the upper side.

An example of a length L1 of the pouch 10 in the x direction is 100 mm to 180 mm, and an example of a length L2 in the y direction is 100 mm to 200 mm. The pouch 10 has a pair of sheets 16 and 18 (refer to FIGS. 3 and 4) that are aligned one over another, and a sheet 20 (refer to FIG. 1).

The pair of sheets 16 and 18 are a front sheet (or a first side sheet) and a rear sheet (or a second side sheet) of the pouch 10. A shape of the pair of sheets 16 and 18 in a plan view (a shape seen in a thickness direction) may be, for example, a rectangle or a square. Each of the sheets 16 and 18 is a laminated body (or a laminated film) having a sealant layer on one surface thereof. The pair of sheets 16 and 18 are disposed so that the sealant layers face each other.

The sheet 20 is a sheet for forming the bottom portion 12 of the pouch 10. The sheet 20 is also a laminated body (or a laminated film) having a sealant layer on one surface thereof.

Examples of materials for the sheets 16, 18 and 20 include polyethylene terephthalate (PET), nylon (NY), and an olefin-based resin. The sheets 16, 18 and 20 can be formed, for example, by laminate processing. In one embodiment, examples of a material of the sealant layer included in the sheets 16, 18 and 20 are axially non-oriented polypropylene (CPP: cast polypropylene) and linear polyethylene (LLDPE: linear low density polyethylene). In one embodiment, the sealant layer is made of a heat resistant material.

The sheets 16, 18 and 20 include, for example, an outermost layer, an intermediate layer, and an innermost layer. The outermost layer is a layer located on the side opposite to the innermost layer with respect to the intermediate layer.

The outermost layer is mainly excellent in gas blocking property and heat resistance. An example of a material that constitutes the outermost layer is a transparent material. Examples of the transparent material include PET, transparent vapor deposition films and the like. An example of the transparent vapor deposition film is a biaxially oriented polypropylene film (OPP: oriented polypropylene). An example of the material that constitutes the outermost layer is polyethylene terephthalate on which an inorganic thin film is vapor-deposited (hereinafter referred to as "transparent vapor deposition PET"). The intermediate layer is mainly excellent in heat resistance and moisture resistance. Printing may be applied to an inner surface of the outermost layer (on the innermost layer side). For example, a pattern, a text of a product description, or the like may be printed on the inner surface of the outermost layer. In this case, the outermost layer preferably has excellent printability. The intermediate layer is mainly excellent in heat resistance and moisture resistance. The intermediate layer is made of, for example, a material having excellent tearability in a flow direction of a resin. An example of the material that constitutes the intermediate layer is nylon. In a more preferable example, the material that constitutes the intermediate layer is nylon having excellent tearability in the flow direction of the resin (hereinafter, referred to as "linearly cuttable NY"). The intermediate layer may further include, for example, a first adhesive layer, a main body layer, and a second adhesive layer. The main body layer is a main body of the intermediate layer and is, for example, a layer formed of the linearly cuttable NY. The main body layer may be an oriented nylon layer. The main body layer may be a laminate of a PET film and a nylon film. In this case, for example, the PET film and the nylon film may be disposed so that the PET film is located on the innermost layer side and the nylon film is located on the outermost layer side. The first adhesive layer is provided between the outermost layer and the main body layer to bond the outermost layer and the main body layer. The second adhesive layer is provided between the main body layer and the innermost layer to bond the main body layer and the innermost layer. An example of a material that constitutes each of the adhesive layers is a dry laminate adhesive. The innermost layer is provided on the side opposite to the outermost layer with respect to the intermediate layer. The innermost layer has excellent heat resistance, heat sealability, and impact resistance. The innermost layer is, for example, a sealant layer having the above-described characteristics. The sealant layer is made of a material having excellent tearability in the flow direction of the resin. The sealant layer is a layer formed of non-oriented polypropylene (hereinafter referred to as "linearly cuttable CPP") having excellent tearability in the flow direction of the resin. Hereinafter, when focusing on heat resistance, non-oriented propylene having heat resistance is also referred to as heat resistant CPP. For example, the printing may be applied to a surface of the intermediate layer on the outermost layer side.

The pair of sheets 16 and 18 that are aligned one over another so that the sealant layers face each other. The sheet 20 is disposed on the bottom portion 12 side of the pouch 10 in the pair of sheets 16 and 18. The sheet 20 is interposed between the aligned sheets 16 and 18 in a state in which the sheet 20 is folded into a self-standing shape (for example, a gusset shape) so that the sealant layer is on the outside. For example, the sheet 20 is inserted between the sheets 16 and 18 in a state in which the sheet 20 is folded into two so that the sealant layer is on the outside.

The perimeter of the pouch 10 is heat-sealed. As a result, the pouch 10 in the closed state has a bottom seal portion 22, a top seal portion 24, and a pair of side seal portions 26 and 28. In FIGS. 1 and 2, in order to clearly indicate the seal portions, the seal portions are hatched. As will be described below, the top seal portion 24 is a seal portion formed after the contents 200 are accommodated in the pouch 10 in the open state.

The bottom seal portion 22 is a portion in which the sheet 20 inserted between the pair of sheets 16 and 18 as described above and the sheets 16 and 18 are heat-sealed. In FIGS. 1 and 2, the bottom seal portion 22 (or the bottom portion 12) has a shape slightly curved from a central portion in the x direction toward both sides, but an outer edge of the bottom seal portion 22 may be on linear.

The top seal portion 24 is a portion in which edge portions of the pair of sheets 16 and 18 on the side (the top portion 14 side) opposite to the bottom seal portion 22 are heat-sealed. The top seal portion 24 is formed by accommodating the contents 200 in the pouch 10 in the open state and then heat-sealing the top portion 14 side.

The pair of side seal portions 26 and 28 are provided to form accommodation space S on both sides in the x direction in the pair of sheets 16 and 18 that are aligned one over another. The pair of side seal portions 26 and 28 connect the bottom seal portion 22 and the top seal portion 24.

One side seal portion 26 of the pair of side seal portions 26 and 28 is a seal portion located on one end side of the pouch 10 in the x direction. The side seal portion 26 is formed by heat-sealing the pair of sheets 16 and 18 along an outer edge of the sheet 16 (or the sheet 18). An example of a seal width W1 (a width in a direction orthogonal to an extending direction) of the side seal portion 26 is 3 mm to 15 mm.

The other side seal portion 28 of the pair of side seal portions 26 and 28 is a seal portion located on the other end side of the pouch 10 in the x direction. The side seal portion 28 is configured to allow steam generated when the pouch 10 is heated to escape to the outside. Specifically, the side seal portion 28 has an upper seal portion (a first seal portion) 30, a lower seal portion (a second seal portion) 32, and a steam discharge seal portion 34.

The upper seal portion 30 is a portion of the side seal portion 28 located closer to the top portion 14. The upper seal portion 30 is formed by heat-sealing the pair of sheets 16 and 18 along the outer edge of the sheet 16 (or the sheet 18). An example of a seal width W2 of the upper seal portion 30 is the same as the example of the seal width W1 of the side seal portion 26. In the present embodiment, although the seal width W2 is the same as the seal width W1, the seal width W2 may be different from the seal width W1.

The lower seal portion 32 is a portion of the side seal portion 28 located closer to the bottom portion 12 than the upper seal portion 30. The lower seal portion 32 is separated from the upper seal portion 30 in the y direction. Therefore, a region in the sheets 16 and 18 between the lower seal portion 32 and the upper seal portion 30 in the y direction is an unsealed region. The lower seal portion 32 is formed by heat-sealing the pair of sheets 16 and 18 along the outer edge of the sheet 16 (or the sheet 18). An example of a seal width W3 of the lower seal portion 32 is the same as the example of the seal width W1 of the side seal portion 26. In the present embodiment, although the seal width W3 of the lower seal portion 32 is the same as the seal width W2 of the upper seal portion 30, the seal width W3 may be different from the seal width W2. For example, the seal width W3 may be narrower than the seal width W2.

The steam discharge seal portion 34 is a portion provided in the side seal portion 28 to allow steam generated when the pouch 10 is heated to escape to the outside. The steam discharge seal portion 34 is provided closer to the top portion 14 than a region in the accommodation space S that is filled with the contents 200. The steam discharge seal portion 34 is a portion that connects the upper seal portion 30 and the lower seal portion 32. The steam discharge seal portion 34 is also a portion that protrudes to the accommodation space S side. Therefore, the side seal portion 28 has a shape recessed toward the accommodation space S at a portion of the steam discharge seal portion 34. The steam discharge seal portion 34 is formed by heat-sealing the sheets 16 and 18 in a shape of the steam discharge seal portion 34. In one embodiment, seal strength of the steam discharge seal portion 34 is smaller than seal strength of each of the upper seal portion 30, the lower seal portion 32, and the side seal portion 26 so that steam can easily escape from the steam discharge seal portion 34. For example, a seal width of the steam discharge seal portion 34 may be narrower than the seal width W2 of the upper seal portion 30 and the seal width W3 of the lower seal portion 32.

Figure 5:
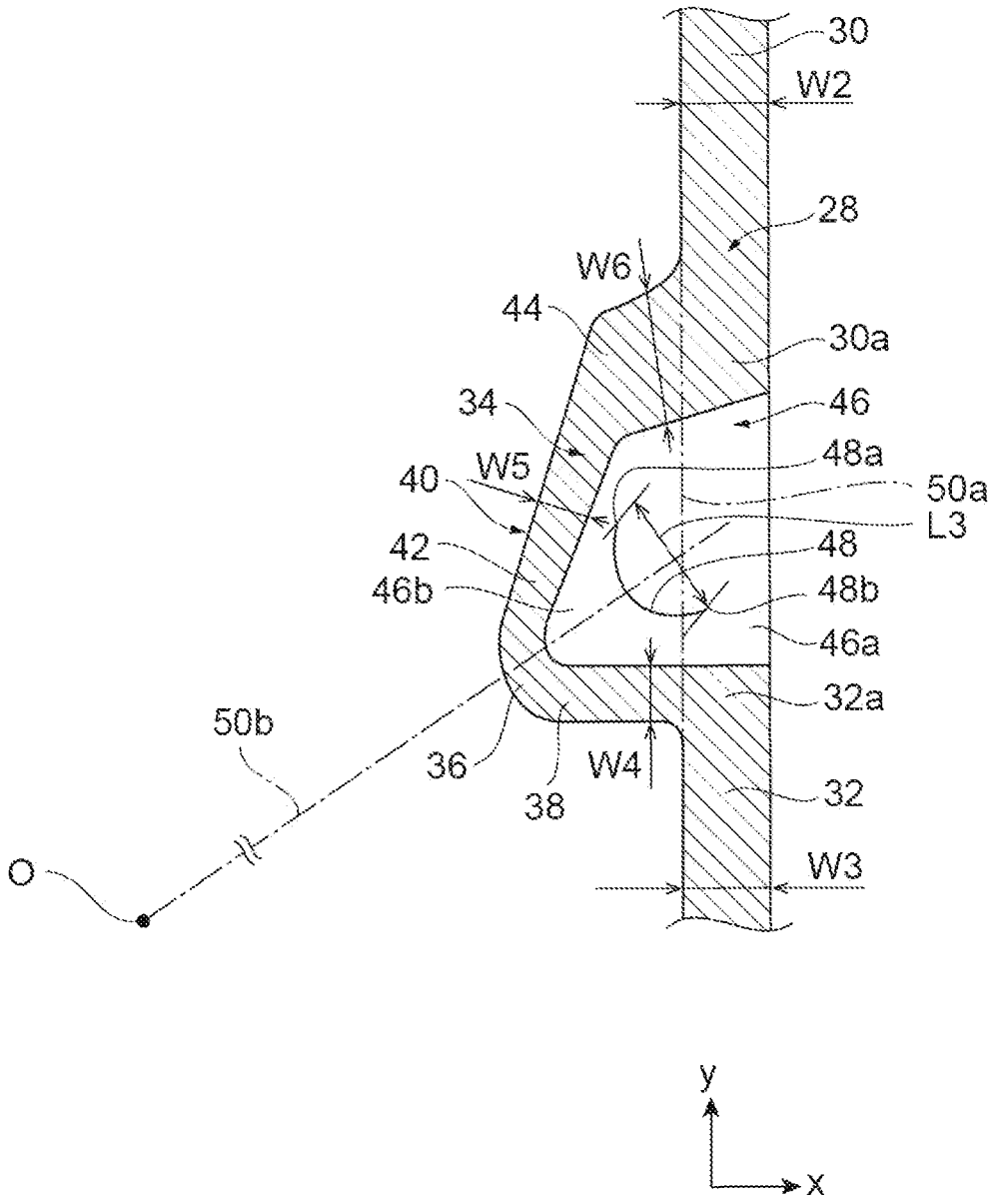
FIG. 5 is an enlarged view of the vicinity of a steam discharge seal portion.

The steam discharge seal portion 34 will be further described with reference mainly to FIG. 5. FIG. 5 is an enlarged view of the steam discharge seal portion 34. The steam discharge seal portion 34 has a tip end portion 36, a first connection portion 38, and a second connection portion 40. In the example shown in FIG. 5, the shape of the steam discharge seal portion 34 is substantially V-shaped. Also in FIG. 5, hatching is provided to the seal portions to clearly indicate the seal portions.

The tip end portion 36 is provided at a portion at which strong stress concentration occurs in the sheets 16 and 18, for example, when the pressure in the accommodation space S increases due to heating of the contents 200. The tip end portion 36 is, for example, a portion closest to a center O (refer to FIGS. 2 and 5) of the accommodation space S. In one embodiment, the steam discharge seal portion 34 may be formed so that the tip end portion 36 faces the center O. The tip end portion 36 is usually located closer to the top portion 14 than the center O in the y direction.

The center O is a center of the accommodation space S when the pouch 10 is seen in a plan view (when seen in the x direction and the y direction). In the present embodiment, the center O is an intersection of a line that passes through a midpoint in the y direction at the edge portion of the side seal portion 26 on the accommodation space S side and is parallel to the x direction and a line that passes through a midpoint in the x direction at the edge portion of the top seal portion 24 on the accommodation space S side and is parallel to the y direction. The center O may be, for example, a center of a sphere having a maximum radius that fits in the accommodation space S of the pouch 10 in the closed state. The center O usually coincides with a center of the sheet 16 (or the sheet 18).

The tip end portion 36 is also a corner portion that connects the first connection portion 38 and the second connection portion 40. The tip end portion 36 is located closer to the bottom seal portion 22 in the steam discharge seal portion 34, for example. The tip end portion 36 may be curved toward the accommodation space S side as shown in FIG. 5.

The first connection portion 38 is a portion that connects the tip end portion 36 and the lower seal portion 32. The first connection portion 38 is a lower seal portion in the steam discharge seal portion 34. An end of the first connection portion 38 on the side opposite to the tip end portion 36 is continuously connected to an end portion 32*a* of the lower seal portion 32. The first connection portion 38 is along the x direction. A seal width W4 of the first connection portion 38 is, for example, constant. An example of the seal width W4 is 3 mm to 10 mm. In the example shown in FIG. 5, the seal width W4 is narrower than the seal width W2 and the seal width W3.

A connection portion between the first connection portion 38 and the lower seal portion 32 may be located closer to the bottom portion 12 than the end portion 32*a* of the lower seal portion 32. The first connection portion 38 may be inclined to the bottom portion 12 side toward the tip end portion 36. That is, in the y direction, the tip end portion 36 may be located on the bottom portion 12 side with respect to the connection portion between the first connection portion 38 and the lower seal portion 32. The seal width W4 may change in the x direction. For example, the seal width W4 may be narrowed toward the tip end portion 36.

The second connection portion 40 is a portion that connects the tip end portion 36 and the upper seal portion 30. In the example shown in FIG. 5, the second connection portion 40 extends from the tip end portion 36 toward the upper seal portion 30 and is inclined with respect to the y direction. An end of the second connection portion 40 on the side opposite to the tip end portion 36 is continuously connected to an end portion 30*a* of the upper seal portion 30.

The second connection portion 40 has a first portion 42 and a second portion 44 having different inclination angles with respect to the y direction.

The first portion 42 is a portion of the second connection portion 40 on the tip end portion 36 side. An example of a seal width W5 of the first portion 42 is 3 mm to 10 mm. In the example shown in FIG. 5, the seal width W5 is narrower than the seal width W2 and the seal width W3. The seal width W5 may be changed to be wider on the second portion 44 side than the tip end portion 36. However, the seal width W5 may be the same as the seal width W2 and the seal width W3. The seal width W5 may be constant.

The second portion 44 is a portion of the second connection portion 40 between the first portion 42 and the upper seal portion 30. The second portion 44 is inclined at an inclination angle larger than the inclination angle of the first portion 42 with respect to the y direction. Therefore, the second connection portion 40 is bent at a connection point between the first portion 42 and the second portion 44. Normally, the connection portion (a bent portion) between the first portion 42 and the second portion 44 is located closer to the upper seal portion 30 in the second connection portion 40. An example of a seal width W6 of the second portion 44 is 3 mm to 15 mm. In the example shown in FIG. 5, the seal width W6 is wider than the seal width W5 of the first portion 42, but may be the same.

A first region 46*a* between the upper seal portion 30 and the lower seal portion 32 in the y direction and a second region 46*b* surrounded by the steam discharge seal portion 34 (specifically, a region surrounded by the first region 46*a* and the steam discharge seal portion 34) are unsealed regions (steam discharge regions) 46 in which the pair of sheets 16 and 18 are not sealed. That is, in the pair of sheets 16 and 18, the side opposite to the side seal portion 26 in the x direction is sealed so that the unsealed region 46 is formed.

As shown in FIGS. 4 and 5, a penetration portion 48 that penetrates the sheet 16 and the sheet 18 in a thickness direction (a direction orthogonal to the x direction and the y direction) is formed in the unsealed region 46. The penetration portion 48 is, for example, a notched portion, a cutout portion, a cut portion, or the like. In one embodiment, as shown in FIG. 5, a part of the penetration portion 48 is located closer to the accommodation space S than a virtual line (a first virtual line) 50*a* that is an extension of an edge portion of the upper seal portion 30 or the lower seal portion 32 that is located closest to the accommodation space S. As shown in FIG. 2, the penetration portion 48 is located on a virtual line 50*b* (a second virtual line) that virtually connects the center O and the tip end portion 36, for example. For example, a portion of the penetration portion 48 closest to the center O may be located on the virtual line 50*b*.

A shape of the penetration portion 48 in a plan view is, for example, an arc shape (for example, a circular arc shape, a crescent shape, or the like) curved toward the inside of the pouch 10 (for example, the center O side of the accommodation space S). As described above, in one embodiment, a portion of the penetration portion 48 located closest to the center O of the accommodation space S is located on the virtual line 50*b*. When the arc-shaped penetration portion 48 is seen in a plan view, an example of a length L3 between a first end 48*a* and a second end 48*b* (an end on the side opposite to the first end 48*a*) of the penetration portion 48 is 5 mm to 15 mm, and preferably 7.5 mm or more.

The penetration portion 48 can be formed, for example, by making a notch (or a cut) in the sheet 16 and the sheet 18 with a blade having a shape of the penetration portion 48, or by cutting out the sheet 16 and the sheet 18.

In one embodiment, at least one pair of notches n may be formed in the pair of side seal portions 26 and 28, as shown in FIGS. 1 and 2. At least one pair of notches n are cutouts for opening the pouch 10 after the contents 200 are heated. FIGS. 1 and 2 show an example in which the pouch 10 has two pair of notches n1 and n2. The two pair of notches n1 and n2 will be described with reference to FIG. 2.

The pair of notches n1 are formed closer to the top seal portion 24. In the example shown in FIG. 2, the pair of notches n1 are formed so that one of the pair of notches n1 is located at the upper seal portion 30. The pair of notches n1 are cutouts for the end user to open the pouch 10 in order to take out the heated contents 200 from the pouch 10 into, for example, another container (for example, a dish). The pair of notches n1 may be formed so that the pouch 10 is opened when the pouch 10 is broken from one of the pair of notches n1 toward the other.

The pair of notches n2 are formed between the region in the accommodation space S of the pouch 10 in which the contents 200 are accommodated and the pair of notches n1. In this case, the pair of notches n2 are located below the steam discharge seal portion 34. In the example shown in FIG. 2, the pair of notches n2 are formed so that one of the pair of notches n2 is located at the lower seal portion 32. The pair of notches n2 are notches provided so that, for example, when the pouch 10 is broken from one of the pair of second notches toward the other, the end user can use the bottom seal portion 22 side of the pouch 10 with respect to the one notch n2 as a container for the contents 200. As in the example shown in FIG. 2, a ridge portion (or a tub) may be provided on both sides in the y direction with respect to one of the pair of notches n2 located on the side seal portion 26 side. Thus, the pouch 10 is easily broken from the one of the pair of notches n2 on the side seal portion 26 side toward the other. Such a ridge portion may be provided for, for example, one of the pair of notches n1. A planned opening line (a cutting line) may be formed on each of the pair of sheets 16 and 18 to connect the pair of notches n2, such that the pouch 10 can be easily opened. The planned opening line is, for example, a set of perforations. The planned opening line may be provided in a horizontal direction (the x direction in FIG. 1). In this case, when the pouch 10 is opened, a horizontal cut can be maintained. A similar planned opening line may be provided for the pair of notches n1.

As described above, in order to break the pouch 10 when the pouch 10 is opened, for example, it is preferable that the layers that constituting the pair of sheets 16 and 18 be formed of a material having excellent tearability, as described above.

The pouch 10 can be manufactured, for example, as follows.

The pair of sheets 16 and 18 overlap each other so that the sealant layers thereof face each other. As described above, the sheet 20 having the sealant layer located on the outside and folded into a self-standing shape is sandwiched between the pair of sheets 16 and 18 that overlap each other. In this state, the sheets 16, 18, and 20 are heat-sealed to form the bottom seal portion 22 and the pair of side seal portions 26 and 28. Then, the penetration portion 48 is formed in the unsealed region 46 provided on the side seal portion 28 side. Thus, the pouch 10 in the open state can be obtained.

In the pouch 10 in the open state, the top portion 14 opens. Therefore, the contents 200 are accommodated in the accommodation space S through an opening thereof. Then, the top portion 14 is heat-sealed to form the top seal portion 24. Thus, the pouch 10 in the closed state is obtained.

A process of forming the penetration portion 48 is not limited to after the bottom seal portion 22 and the pair of side seal portions 26 and 28 are formed, as described above. The penetration portion 48 is formed at any stage until the contents 200 are accommodated in the accommodation space S. For example, the sheets 16 and 18 having the penetration portion 48 formed in advance may be prepared.

When the pouch 10 has at least one pair of notches n, for example, the sheets 16 and 18 having at least one pair of notches n formed in advance may be prepared to manufacture the pouch 10, or at least one pair of notches n may be formed at any stage until the contents 200 are accommodated in the accommodation space S.

Next, an operation and effect of the pouch 10 will be described. First, for example, a case in which the pouch 10 is heated with a power (for example, about 600 W) in a household microwave oven or the like will be described.

In this case, steam is generated by heating the contents 200, and the pressure in the accommodation space S increases. The pouch 10 has the steam discharge seal portion 34. The steam discharge seal portion 34 protrudes to the accommodation space S side. Further, since the tip end portion 36 of the steam discharge seal portion 34 is close to the center O of the accommodation space S, strong stress concentration occurs when the pressure in the accommodation space S increases. Therefore, normally, the steam discharge seal portion 34 starts to be peeled off from the tip end portion 36, and the peeling proceeds along the shape of the steam discharge seal portion 34. Due to the peeling, an opening is formed in the steam discharge seal portion 34, and thus the accommodation space S and the unsealed region 46 are connected. As a result, the unsealed region 46 functions as a steam vent for releasing steam, and the steam in the accommodation space S escapes to the outside of the pouch 10 through the unsealed region 46.

Next, a case in which the pouch 10 is heated under a high power (for example, a microwave of 1000 W or more) will be described in comparison with a case in which the penetration portion 48 is not formed in the unsealed region 46. For convenience of explanation, even in the description when the penetration portion 48 is not formed, the same reference numerals are given to elements corresponding to the constituent elements of the pouch 10 described so far. Heating of the pouch 10 under a high power corresponds to, for example, heating in a commercial microwave oven in a convenience store.

When the pouch 10 is heated with a microwave having a high power (for example, a power of 1000 W or more), for example, the contents 200 are more likely to be heated rapidly than when the contents 200 are heated by a power of a household microwave oven (600 W or the like). As a result, since steam is rapidly generated, the speed of increase of the internal pressure of the accommodation space S also increases. In this case, the present inventor has found that, when the penetration portion 48 is not provided in the unsealed region 46, the peeling of the steam discharge seal portion 34 proceeds at once and the vicinity of the center O rapidly expands, and thus the unsealed region 46 (particularly, the outer edge side of the sheets 16 and 18 in the unsealed region 46) is blocked. As described above, when the unsealed region 46 is blocked, the pouch 10 may burst without the steam being released, or the other seal portions may be peeled off, and the contents 200 may pop out from the pouch 10.

On the other hand, the pouch 10 according to the present embodiment has the penetration portion 48 in the unsealed region 46. In this case, even when the internal pressure of the pouch 10 heated with high power increases sharply, the penetration portion 48 functions as a steam vent for releasing steam, and thus the above-described problem when the penetration portion 48 is not provided can be solved, and the pouch 10 (specifically, the contents in the pouch 10) can be safely heated even under a high power.

When at least apart of the penetration portion 48 is located on the accommodation space S side with respect to the virtual line 50*a*, it is possible to prevent deformation such as bending of the upper seal portion 30, the lower seal portion 32, and the like.

Further, when at least a part of the penetration portion 48 is located on the accommodation space S side with respect to the virtual line 50*a*, since a portion of the penetration portion 48 located on the accommodation space S side with respect to the virtual line 50*a* easily functions as at least the above-described steam vent under a high power, the pouch 10 can be heated more safely even under a high power.

In addition, steam is released more reliably. When at least a part of the penetration portion 48 is located on the accommodation space S side with respect to the virtual line 50*a*, steam can be easily released from the penetration portion 48 before peeling occurs at least in the seal portions (for example, the upper seal portion 30, the lower seal portion 32, or the like) other than the steam discharge seal portion 34.

When steam is generated, the steam tends to propagate outward from the center O, and thus when the penetration portion 48 is located on the virtual line 50*b*, the steam can more easily escape from the penetration portion 48. When a portion of the penetration portion 48 closest to the center O is located on the virtual line 50*b*, the steam can much more easily escape from the penetration portion 48.

When the penetration portion 48 has an arc shape curved toward the accommodation space S, steps are formed on both sides of the penetration portion 48 (for example, both sides in the x direction or a direction along the virtual line 50*b*), and a large opening is likely to be formed by the sheet 16 and the sheet 18. For example, when the pressure in the accommodation space S increases rapidly, the center O side of the accommodation space S swells, while the vicinity of the sheets 16 and 18 in the unsealed region 46 is closed as described above. Therefore, the above-described step is generated, and a larger opening is likely to be formed. As a result, since steam is easily released, the pouch 10 can be heated more safely under a high power.

When the intermediate layers of the sheets 16 and 18 are formed of, for example, nylon, drop resistance of the pouch 10 is improved. Further, certain elasticity is ensured, and the user can easily handle the pouch 10. When the intermediate layer is a laminate of a PET film and a nylon film, the drop resistance is more likely to be improved, and the certain elasticity is easily ensured. For example, when the intermediate layer is the laminate of a PET film and a nylon film, the sheets 16 and 18 may be layers in which a heat resistant CPP (a sealant layer), a PET film, a nylon film and a transparent vapor deposition film (the outermost layer) are laminated in this order.

Next, an experimental example will be described.

Figure 6:
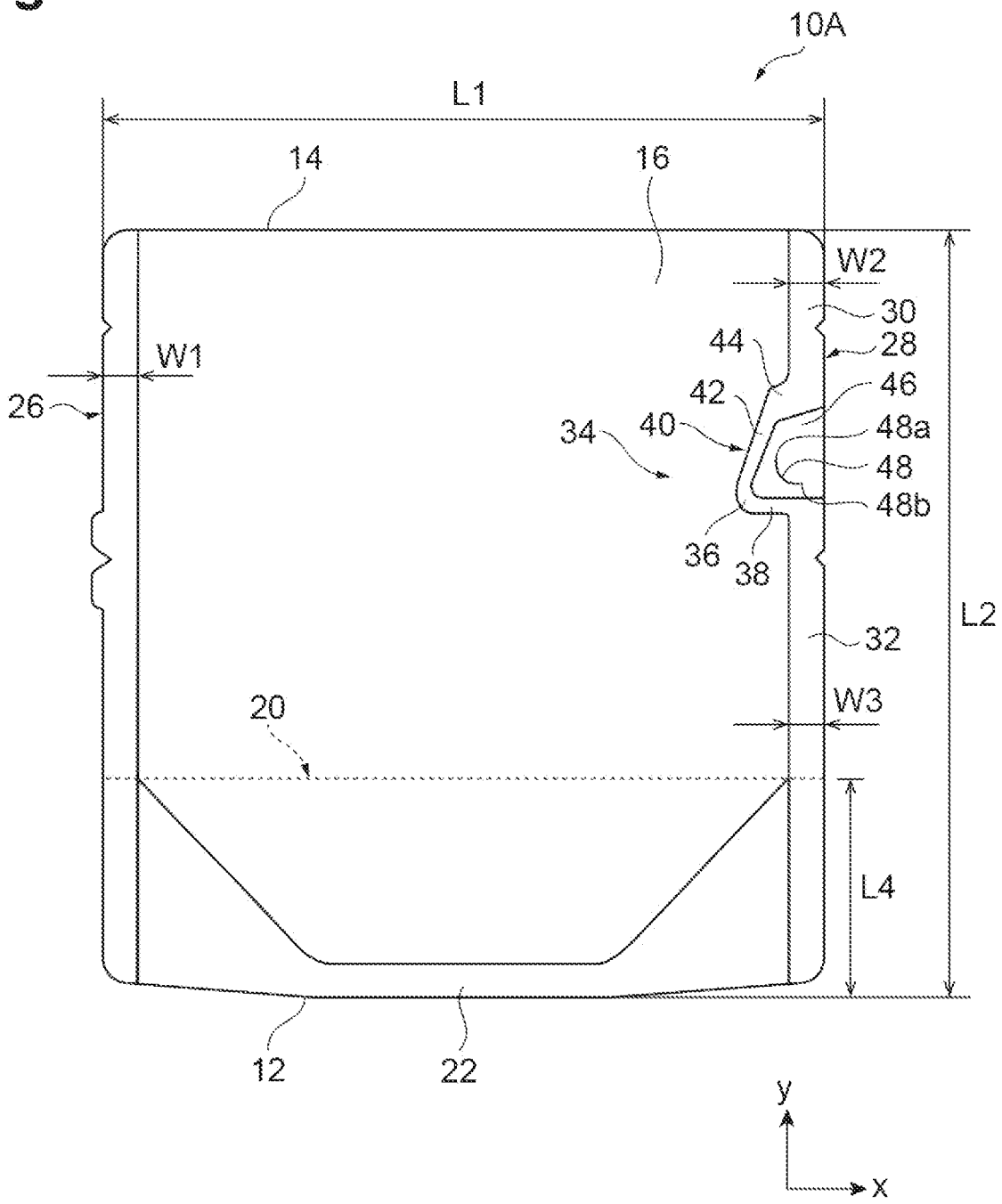
FIG. 6 is a plan view of a pouch having a basic configuration used in an experiment.

In the experimental example, a pouch 10A shown in FIG. 6 was used as a basic configuration, and a plurality of experiments were performed by changing the size, position, and the like of the penetration portion 48. The pouch 10A as a basic configuration is the same as the configuration of the pouch 10 shown in FIGS. 1 and 2. The pouch 10A shown in FIG. 6 is a pouch in the open state. The pouch 10A will be described by assigning the same reference numerals to the elements corresponding to the constituent elements of the pouch 10. In the description of the pouch 10A, description overlapping the description of the pouch 10 will be omitted as appropriate.

The layer structure of the sheets 16, 18 and 20 included in the pouch 10A was as follows.

Transparent Vapor Deposition PET Film/PET Film/Heat Resistant CPP Film

A thickness of the transparent vapor deposition PET film was 12 μm. A thickness of the PET film was 12 μm. A thickness of the heat resistant CPP film was 60 μm. In the above-described layer structure, the heat resistant CPP was a sealant layer.

The side seal portion 26 was a seal portion having the constant seal width W1. The side seal portion 28 was a seal portion having the upper seal portion 30, the lower seal portion 32, and the steam discharge seal portion 34. The seal width W2 of the upper seal portion 30 was constant. The seal width W3 of the lower seal portion 32 was constant.

In the first connection portion 38 of the steam discharge seal portion 34, the end opposite to the tip end portion 36 was continuously connected to the end portion 32*a* of the lower seal portion 32. In the second connection portion 40 of the steam discharge seal portion 34, the end opposite to the tip end portion 36 was continuously connected to the end portion 34*a* of the upper seal portion 30. The second connection portion 40 had the first portion 42 and the second portion 44.

The penetration portion 48 was formed in the sheets 16 and 18 in the unsealed region 46. The penetration portion 48 had an arc shape curved toward the center O of the accommodation space S.

The pouch 10A was manufactured as follows. After the pair of sheets 16 and 18 having the above-described layer structure are aligned one over another, the sheet 20 folded into two was inserted between them so that the heat resistant CPP film faced outward. Then, the sheets 16, 18 and 20 were heat-sealed to form the bottom seal portion 22 and the pair of side seal portions 26 and 28. Then, the penetration portion 48 was formed in the unsealed region 46 formed by the side seal portion 28. The penetration portion 48 was formed by pushing a blade having the shape of the penetration portion 48 into the sheets 16 and 18.

Figure 7:
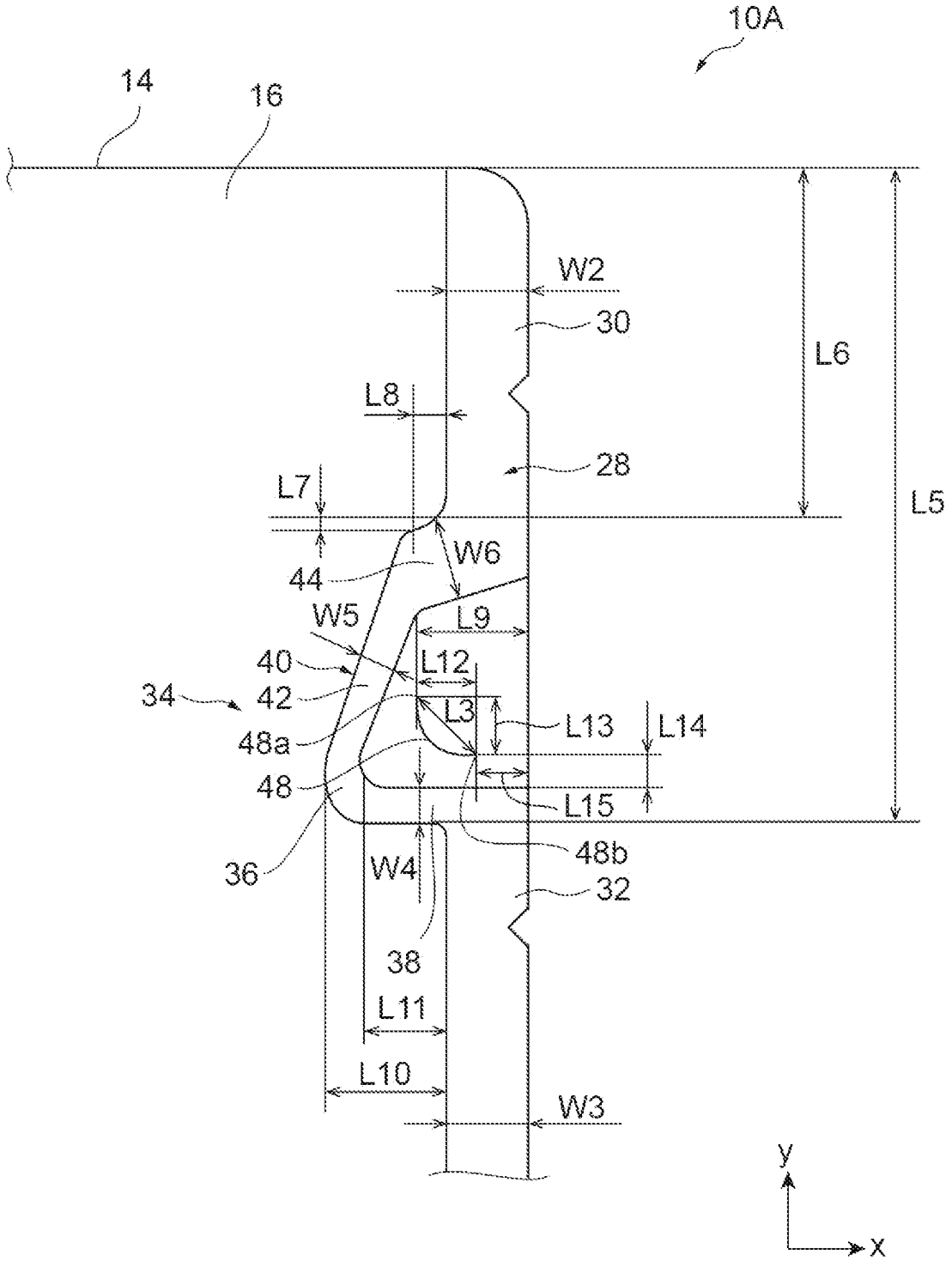
FIG. 7 is an enlarged view of the vicinity of a steam discharge seal portion in the pouch shown in FIG. 6.

Dimensions of the pouch 10A will be described with reference to FIGS. 6 and 7. The dimensions of the pouch 10A were as follows.

- A length L1 (refer to FIG. 6) of the pouch 10A in the x direction was 150 mm.
- A length L2 of the pouch 10A in the y direction was 158 mm.
- A length L4 of the sheet 20 folded into two when the pouch 10A in the open state was seen in a plan view was 45 mm.
- A seal width W1 of the side seal portion 26, a seal width W2 of the upper seal portion 30, and a seal width W3 of the lower seal portion 32 were all 8 mm.
- A length L5 (refer to FIG. 7) from an outer edge of the top portion 14 to a lower edge of the first connection portion 38 was 58 mm.
- A length L6 from the outer edge of the top portion 14 to a first intersection (an intersection on the top portion 14 side) of the second connection portion 40 and the upper seal portion 30 was 33.65 mm.
- In the y direction, a length L7 from the first intersection to a second intersection (an intersection on the top portion 14 side) of the first portion 42 and the second portion 44 was 0.65 mm.
- In the x direction, a length L8 from an edge portion of the upper seal portion 30 on the accommodation space S side to the second intersection was 3.37 mm.
- In the x direction, a length L9 from an outer edge of the sheet 16 (or the sheet 18) to a third intersection (an intersection on the bottom portion 12 side) of the first portion 42 and the second portion 44 was 10.18 mm.
- In the x direction, a length L10 between a portion of the tip end portion 36 farthest from the edge portion of the lower seal portion 32 on the accommodation space S side and the edge portion of the lower seal portion 32 on the accommodation space S side was 10 mm.
- In the x direction, a length L11 from the edge portion of the lower seal portion 32 on the accommodation space S side to a connection portion between an edge portion of the first connection portion 38 on the unsealed region 46 side and an edge portion of the second connection portion 40 on the unsealed region 46 side is 7 mm.
- A seal width W4 of the first connection portion 38 was 3 mm.
- A seal width W6 of the second portion 44 of the second connection portion 40 was 7.5 mm.
- The tip end portion 36 was curved, and a radius of curvature of an edge portion of the tip end portion 36 on the accommodation space S side was 4.5 mm.
- In the x direction, a length L12 between the first end 48*a* and the second end 48*b* of the penetration portion 48 was 5.3 mm.
- In the y direction, a length L13 between the first end 48*a* and the second end 48*b* was 5.3 mm.
- In the y direction, a length L14 between the second end 48*b* and an upper end of the lower seal portion 32 was 2.5 mm.
- In the x direction, a length L15 between the second end 48*b* and the sheet 16 (or the sheet 18) was 4.58 mm.
- A radius of curvature of a portion of the penetration portion 48 closest to the center O of the accommodation space S was 4 mm.
- A length L3 between the first end 48*a* and the second end 48*b* of the penetration portion 48 was 7.5 mm.

The first end 48*a* side of the penetration portion 48 created with the above-described dimensions was located on the accommodation space S side with respect to the virtual line 50*a* (refer to FIG. 5) that is an extension of the edge portions of the upper seal portion 30 and the lower seal portion 32 on the accommodation space S side. Further, the penetration portion 48 was located on the virtual line 50*b* (refer to FIG. 5).

Experimental Example 1

In Experimental example 1, after 180 g of water was accommodated in the accommodation space S of the pouch 10A having the basic configuration, the top portion 14 was closed to form the top seal portion 24. The pouch 10A in the closed state that contains 180 g of water was heated in a microwave oven. A power during heating was 1600 W, and a heating time was 30 seconds. It was confirmed whether or not the unsealed region 46 was closed during cooking in the microwave oven.

The above-described experiment was performed with five pouches 10A having the same configuration. A case in which the unsealed region 46 was not completely closed in all five pouches 10A, was evaluated as "A evaluation", and the other cases were evaluated as "B evaluation". The result of Experimental example 1 was A evaluation.

Experimental Example 2

In Experimental example 2, as shown in Table 1, in addition to Experiment 2-1 using the pouch 10A having the basic configuration, Experiment 2-2, Experiment 2-3, and Experiment 2-4 in which the length and position of the penetration portion 48 in the pouch 10A having the basic configuration were changed were performed.

TABLE 1

| | Length L3 | Position of penetration portion 48 |
|---|---|---|
| Experiment 2-1 | 7.5 mm | Reference position |
| Experiment 2-2 | 9.0 mm | Reference position |
| Experiment 2-3 | 7.5 mm | +3 mm |
| Experiment 2-4 | 7.5 mm | −3 mm |

Figure 8:
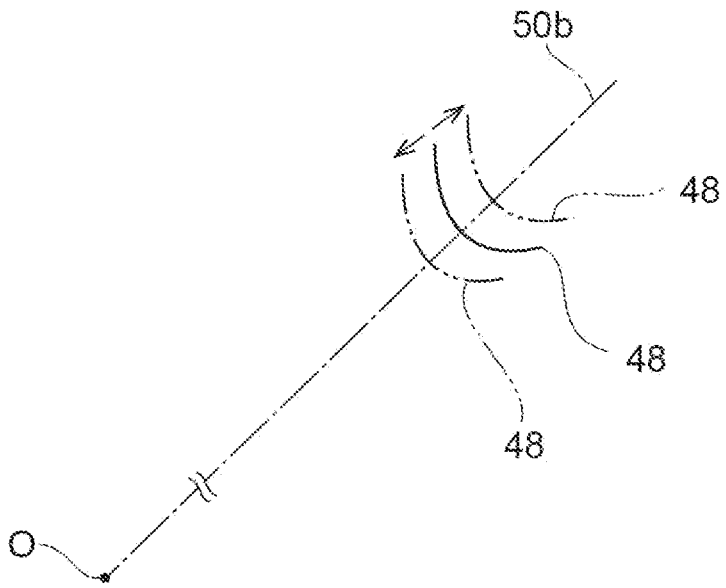
FIG. 8 is a view for describing a position of a penetration portion changed in the experiment.

A "reference position" in Table 1 was the position of the penetration portion 48 described in the pouch 10A of the basic configuration. The position of the penetration portion 48 being "+3 mm" means that, as shown in FIG. 8, the penetration portion 48 is formed at a position translated outward (opposite to the center O) from the reference position of the penetration portion 48 (the position of the penetration portion 48 shown by a solid line) along the virtual line 50*b* by a length of 3 mm. Meanwhile, the position of the penetration portion 48 being "−3 mm" means that, as shown in FIG. 8, the penetration portion 48 is formed at a position at which the penetration portion 48 is translated inward (to the center O side) from the reference position of the penetration portion 48 along the virtual line 50*b* by a length of 3 mm. Regardless of whether the position of the penetration portion 48 is "+3 mm" or "−3 mm", the first end 48*a* side of the penetration portion 48 was located on the accommodation space S side with respect to the virtual line 50*a* (refer to FIG. 5) that is an extension of the edge portions of the upper seal portion 30 and the lower seal portion 32 on the accommodation space S side.

In Experimental examples 2-1 to 2-4, the same experiment as in Experimental example 1 was performed except that 180 g of curry was contained instead of 180 g of water. In Experimental examples 2-1 to 2-4, in addition to the evaluation of the closed state of the unsealed region 46 in Experimental example 1, a peeled state of the seal portion other than the steam discharge seal portion 34 during cooking in a microwave oven was evaluated. In the evaluation of the peeled state of the seal portion, in all the experiments using the five pouches in Experimental examples 2-1 to 2-4, a case in which the peeling did not occur in the seal portions other than the steam discharge seal portion 34 was evaluated as "A evaluation," and the other cases were evaluated as "B evaluation". A method of evaluating the closed state of the unsealed region 46 in Experimental examples 2-1 to 2-4 was the same as in Experimental example 1.

In Experimental example 2, as a comparative experiment, Experiment 2-5 was performed using the pouch in a state before the penetration portion 48 is formed in the pouch 10A. An experimental method and evaluation method of Experiment 2-5 were the same as those of Experimental examples 2-1 to 2-4.

The experimental results of Experiment 2-1 to Experiment 2-5 are shown in Table 2. "Evaluation of peeled state" in Table 2 is an evaluation of the peeled state of the seal portions other than the steam discharge seal portion 34. "Evaluation of closed state" in Table 2 is an evaluation of the closed state of the unsealed region 46.

TABLE 2

| | Evaluation of peeled state | Evaluation of closed state |
|---|---|---|
| Experiment 2-1 | A | A |
| Experiment 2-2 | A | A |
| Experiment 2-3 | A | A |
| Experiment 2-4 | A | A |
| Experiment 2-5 | B | B |

As shown in the results of Experiment 2-5, when the pouch 10A in which the penetration portion 48 was not formed was heated at a high power of 1600 W, the unsealed region 46 was closed. On the other hand, in the experiment using the pouch 10A having the penetration portion 48, the unsealed region 46 was not closed. As a result, it was verified that the pouch can be safely heated even under a high power using the pouch having the penetration portion 48 in the unsealed region 46.

The layer structure of the sheets 16, 18 and 20 is not limited to the specific layer structure shown in the above-described experimental example as long as it is a layer structure that can be used as a pouch. For example, another example of the layer structure of the sheets 16, 18 and 20 may have the following structure.

Transparent Vapor Deposition PET Film/NY Film/Heat Resistant CPP Film

Although the first embodiment of the present invention has been described above, the present invention is not limited to the first embodiment.

The shape and size of the penetration portion are not limited as long as the penetration portion has a shape and size that allows the penetration portion to function as an opening for releasing steam during heating the pouch under a high power. The shape and size of the penetration portion may be appropriately designed according to the size and the like of the steam discharge seal portion and the unsealed region within a range not deviating from the gist of the present invention.

Figure 9:
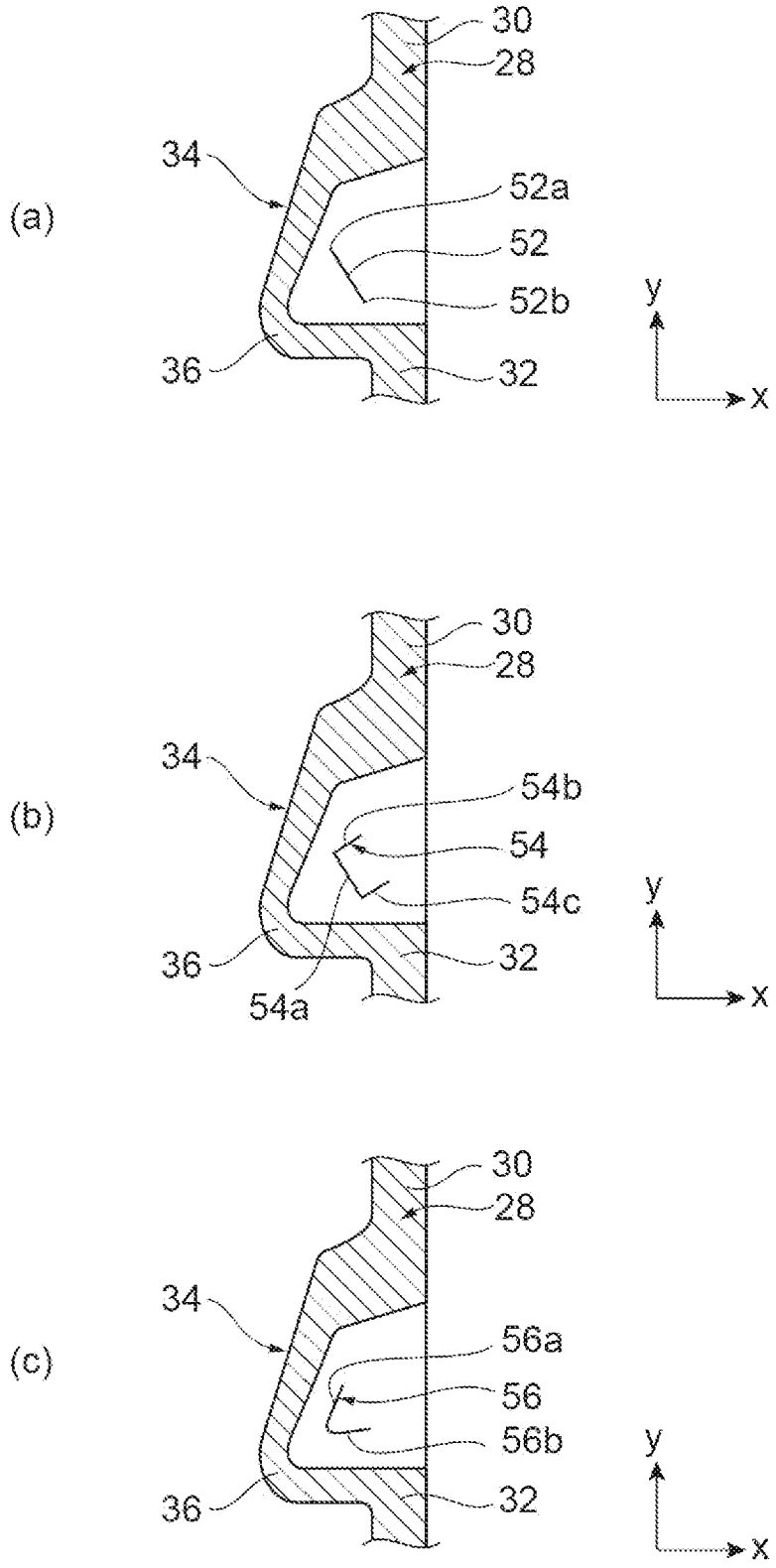
FIG. 9 is a view for describing a modified example of the penetration portion.

For example, the penetration portion may be a linear penetration portion 52 shown in FIG. 9(*a*). For example, the penetration portion 52 may be formed so that the first end 52*a* of the penetration portion 52 is located on the upper seal portion 30 side in the y direction and the second end 52*b* (the end opposite to the first end 52*a*) is located on the lower seal portion 32 side. In this case, the penetration portion 52 may be formed so that the first end 52*a* is located farther from the edge portion of the upper seal portion 30 (or the lower seal portion 32) in the x direction than the second end 52*b*.

The penetration portion may be a U-shaped penetration portion 54 shown in FIG. 9(*b*). The penetration portion 54 has a first portion 54*a*, and a second portion 54*b* and a third portion 54*c* each of which one end is connected to both ends of the first portion 54*a*. In this case, the penetration portion 54 may be formed so that the first portion 54*a* faces the tip end portion 36. At least one of the first portion 54*a*, the second portion 54*b* and the third portion 54*c* may be curved.

The penetration portion may be a V-shaped penetration portion 56 shown in FIG. 9(*c*). The penetration portion 56 shows a case in which a first side portion 56*a* and a second side portion 56*b* are provided, and the first side portion 56*a* and the second side portion 56*b* are connected to each other at a substantially acute angle. In this case, the penetration portion 56 may be formed so that a corner (or a top) formed by the first side portion 56*a* and the second side portion 56*b* faces the tip end portion 36.

Further, the shape of the penetration portion may be S-shaped. The penetration portion may be an open penetration portion in the state before heating. A plurality of penetration portions may be formed in the unsealed region 46. When the plurality of penetration portions are formed in the unsealed region 46, the plurality of penetration portions may have the same shape or different shapes.

The shape of the steam discharge seal portion 34 is not limited to the substantially V-shape exemplified. For example, a U-shaped steam discharge seal portion may be used. Similarly, the shape of the unsealed region 46 is not limited to a trapezoidal shape as shown in FIG. 5.

The steam discharge seal portion may also be formed on the side seal portion 26 exemplified in FIGS. 1 and 2. In this case, the penetration portion may be formed in the unsealed region 46 provided on the side seal portion 26 side. The penetration portion may not be formed in one of the sheet 16 and the sheet 18.

As long as the sheets 16, 18 and the like can be sealed, a sealing method for the sheets 16, 18 and the like is not limited to heat sealing. For example, the sheets 16, 18 and the like may be sealed by ultrasonic sealing, high frequency sealing, or the like. The layer structure and materials of the sheets 16, 18 and the like can be appropriately changed according to the sealing method.

The pouch does not have to have the seat 20. In this case, for example, the perimeter of the pair of sheets that overlap each other may be sealed, and the bottom seal portion may be folded to form a self-standing pouch.

Second Embodiment

The pouch to which the penetration portion described in the first embodiment is applied may be the following steam dischargeable pouch.

That is, the steam dischargeable pouch is a steam dischargeable pouch which includes a first sheet and a second sheet that face each other, and a bottom sheet interposed between the first sheet and the second sheet by folding in a V shape in a side view, and which has a steam discharge portion that releases steam generated from contents or the like, wherein left and right side seal portions, a first bottom seal portion, and a second bottom seal portion are formed, the left and right side seal portions are substantially linear and include a portion that joins the first sheet and the second sheet, and a portion that joins facing surfaces of the folded bottom sheet, the first bottom seal portion includes first left and right bottom side seal portions and a substantially linear first bottom intermediate seal portion that is continuously connected to the first left and right bottom side seal portions between the first left and right bottom side seal portions, at a portion in which the first sheet and the bottom sheet are joined, the second bottom seal portion includes second left and right bottom side seal portions and a substantially linear second bottom intermediate seal portion that is continuously connected to the second left and right bottom side seal portions between the second left and right bottom side seal portions, at a portion in which the second sheet and the bottom sheet are joined, a length A1 in a width direction from a lower end of an inner edge of the portion of the left side seal portion that joins the facing surfaces of the folded bottom sheet to a virtual vertical line with respect to an outer edge of the first or second bottom intermediate seal portion including a portion in which an inner edge of the first or second bottom side seal portion continuously connected to the left side seal portion and an inner edge of the first or second bottom intermediate seal portion continuously connected to the first or second bottom side seal portion intersect each other, and a length A2 in a width direction from a lower end of an inner edge of the portion of the right side seal portion that joins the facing surfaces of the folded bottom sheet to a virtual vertical line with respect to an outer edge of the first or second bottom intermediate seal portion including a portion in which an inner edge of the first or second bottom side seal portion continuously connected to the right side seal portion and an inner edge of the first or second bottom intermediate seal portion continuously connected to the first or second bottom side seal portion intersect each other are equal, and a ratio of the length of A1, a length (B) of the inner edge of the first or second bottom intermediate seal portion in the width direction, and the length of A2 is 1:1:1 to 1:3:1.

A relationship among the A1, the B, the A2, a length (C) in a height direction from the folded portion of the bottom sheet to the lower end of the bottom sheet, and a length (D) of the substantially linear first or second bottom intermediate seal portion in the height direction may satisfy, for example, the following Equation.

$$(A1+B+A2)\times 2 \geq (C-D)\times 3.14\times 2$$

In one embodiment, a length (E1) of the left side seal portion in the width direction and a length (E2) of the right side seal portion in the width direction may be equal to each other.

In one embodiment, an opening guide portion may be formed in a part of the left or right side seal portion, and the opening guide portion may be provided between the steam discharge portion and the folded portion of the bottom sheet.

The relationship between the C and a length (F) in the height direction from the opening guide portion to the lower end of the bottom sheet may satisfy the following Equation.

$$C\times 2 \leq F$$

Figure 10:
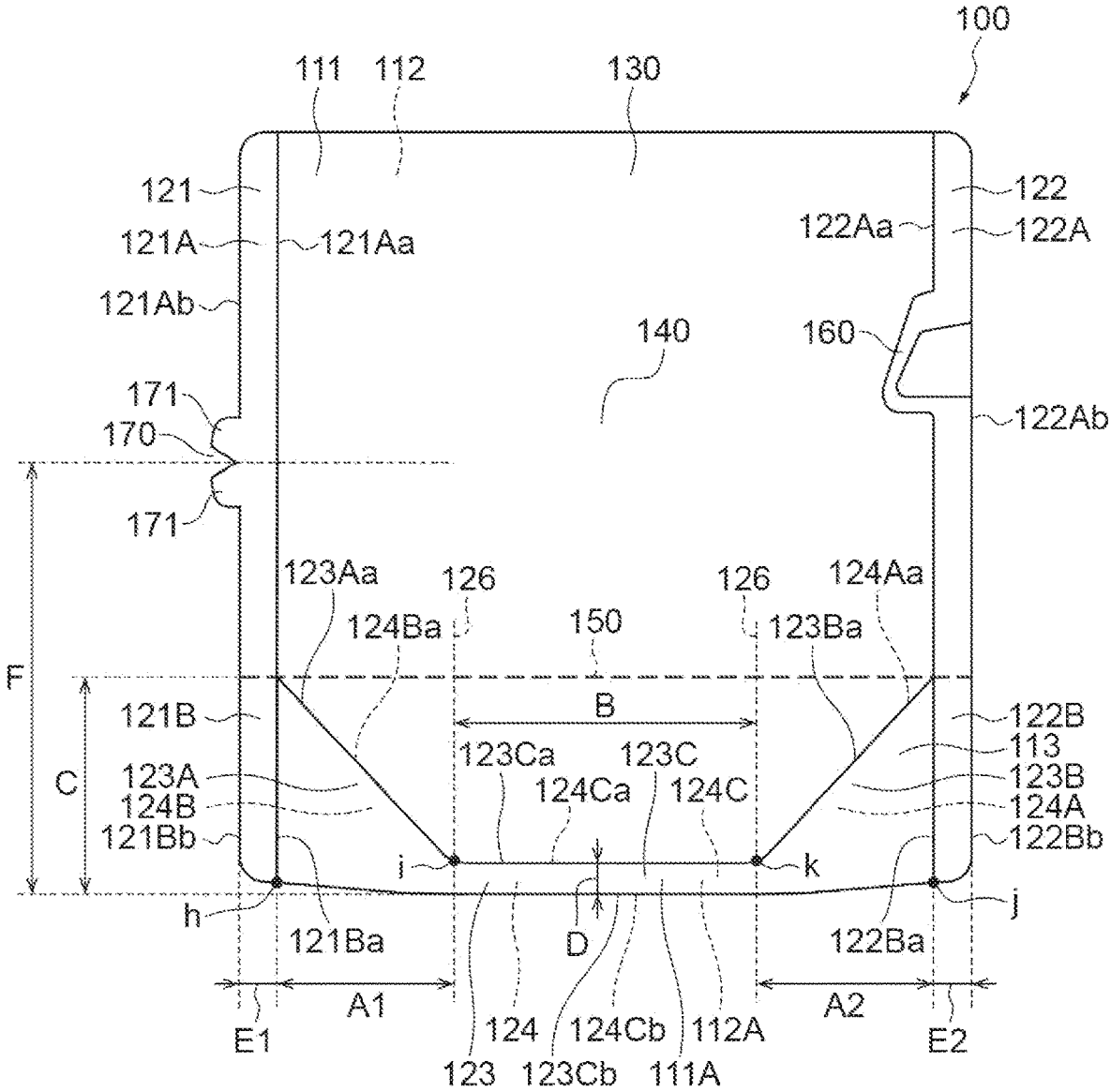
FIG. 10 is a front view of the pouch to which the penetration portion is not applied and before an opening portion is closed.
Figure 11:
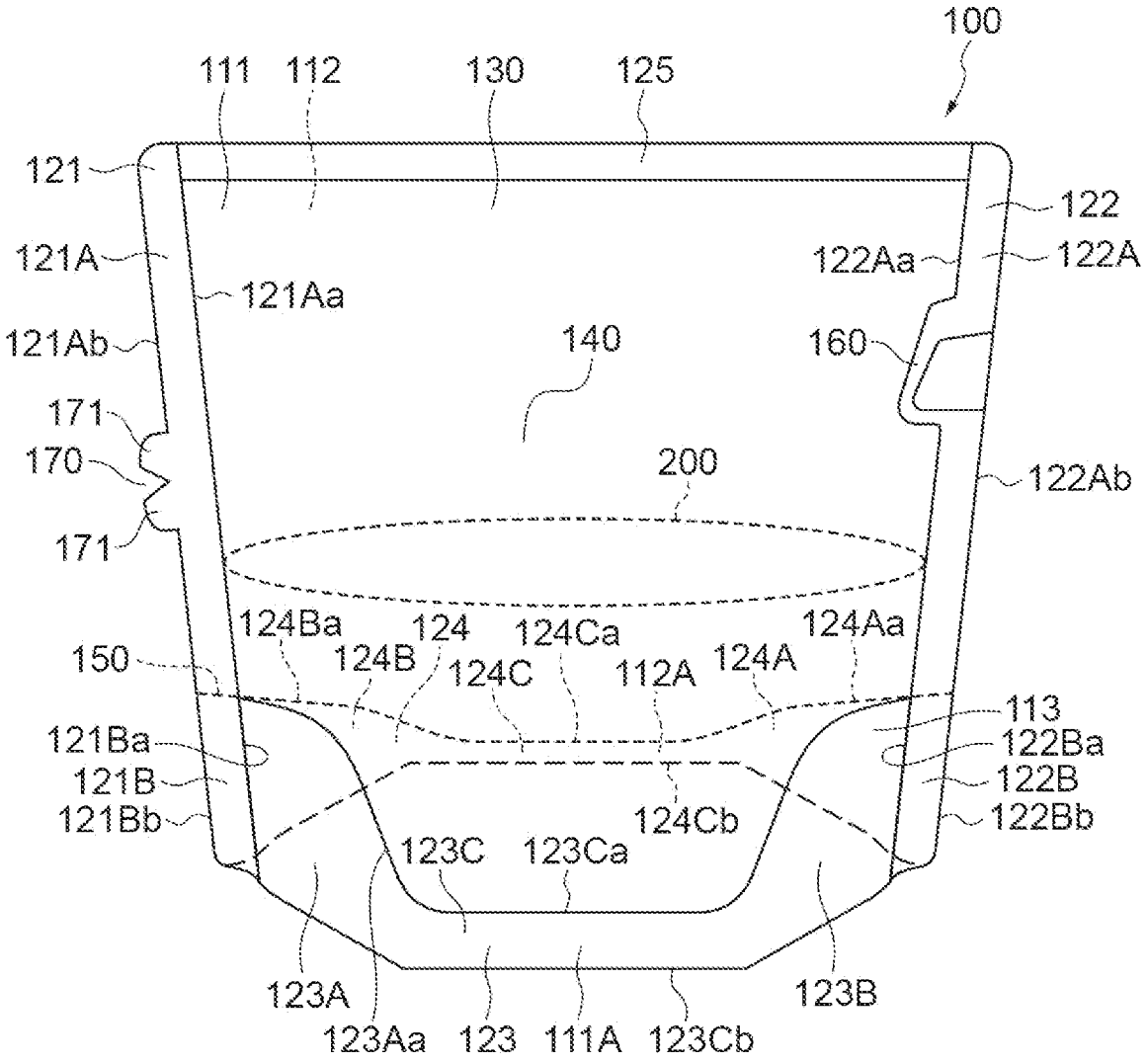
FIG. 11 is a front view of the pouch to which the penetration portion is not applied and after the opening portion is closed.
Figure 12:
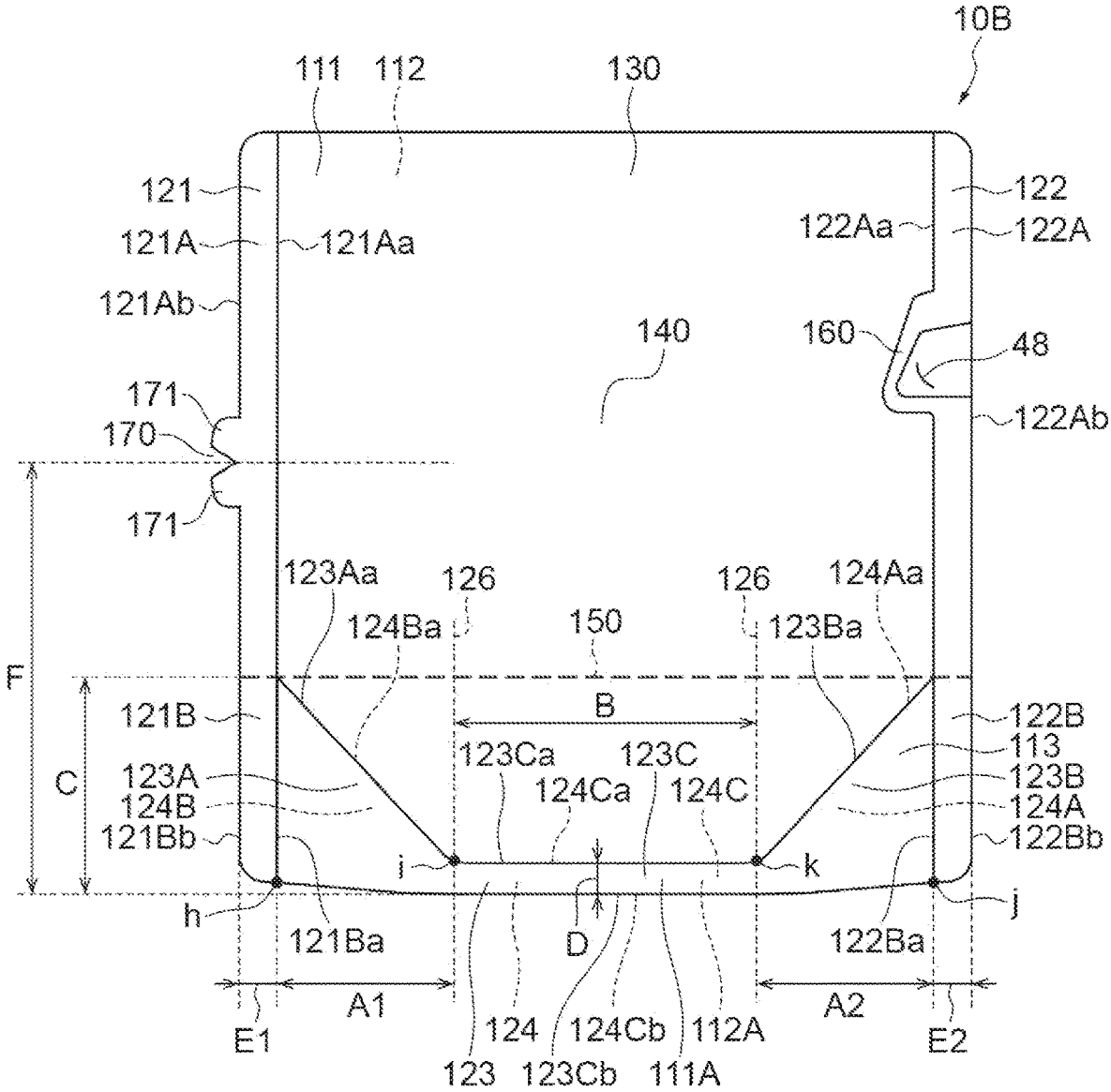
FIG. 12 is a front view of a pouch when the penetration portion is applied to the pouch shown in FIG. 10.

The steam dischargeable pouch in the second embodiment will be specifically described with reference to the drawings. In the following description, the steam dischargeable pouch before the penetration portion 48 described in the first embodiment is applied is referred to as a steam dischargeable pouch 100, and the steam dischargeable pouch 100 to which the penetration portion 48 is applied is referred to as a pouch 10B. FIGS. 10 and 11 are views showing the steam dischargeable pouch 100 before the penetration portion 48 is applied. Specifically, FIG. 10 is a view showing a front view of the steam dischargeable pouch 100 before an opening portion 130 is closed. FIG. 11 is a view showing a front view of the steam dischargeable pouch 100 after the opening portion 130 is closed. FIG. 10 shows a state in which the contents 200 are not accommodated, and FIG. 11 shows a state in which the opening portion 130 is closed after the contents 200 are accommodated. FIG. 12 is a front view showing the pouch 10B (the steam dischargeable pouch 100 to which the penetration portion 48 is applied). FIG. 12 shows the state in which the contents 200 are not accommodated, as in the case of FIG. 10. In FIG. 1 and the like, the seal portion is hatched, but in FIGS. 10 to 12, the hatching in the seal portion is omitted.

The steam dischargeable pouch 100 includes a first sheet 111 and a second sheet 112 (a pair of sheets) that face each other, and a bottom sheet 113 interposed between the first sheet 111 and the second sheet 112 by folding in a V shape in a side view. The bottom sheet 113 is a sheet that forms a bottom portion of the steam dischargeable pouch 100. The steam dischargeable pouch 100 shown in FIGS. 10 and 11 is configured of one sheet. Due to one sheet being bent, the first sheet 111 and the second sheet 112 facing each other are formed, and the bottom sheet 113 disposed on bottom portions 111A and 112A of the first sheet 111 and the second sheet 112 is formed. Unlike the steam dischargeable pouch 100 shown in FIGS. 10 and 11, the first sheet 111, the second sheet 112, and the bottom sheet 113 may be individually formed, and the steam dischargeable pouch 100 may be configured of three sheets.

The example of the contents 200 is the same as the contents 200 in the first embodiment. Examples of the contents 200 include fluid foods such as stews and soups.

An exterior of the steam dischargeable pouch 100 in front view can be arbitrarily selected, and examples thereof include an inverted trapezoid, a square, and the like, in addition to the rectangle shown in FIG. 10. A length in the width direction and a length in the height direction of the entire steam dischargeable pouch 100 are preferably determined, for example, in relation to an amount of the contents 200 to be accommodated and portability. Here, the width direction is a direction substantially parallel to an outer edge 123Cb of the first bottom intermediate seal portion 123C (or an outer edge 124Cb of the second bottom intermediate seal portion 24C) having a substantially linear shape which will be described below. The height direction is a direction perpendicular to the width direction.

The steam dischargeable pouch 100 has left and right side seal portions 121 and 122 (a pair of side seal portions), a first bottom seal portion 123, and a second bottom seal portion 124. A portion surrounded by each of the seal portions 121 to 124 and a closed seal portion 125 (a top seal portion, a top portion) that closes the opening portion 130 is an accommodation portion (an accommodation space) 140. The left and right side seal portions 121 and 122 include portions 121A and 122A that join the first sheet 111 and the second sheet 112, and portions 121B and 122B that join facing surfaces of the folded bottom sheet 113. Here, the left and right sides of the left and right side seal portions 121 and 122 refer to the left and right sides with respect to the first sheet 111 when the first sheet 111 is a front surface as shown in FIG. 10.

For example, as shown in FIG. 1, the portions 121A and 122A of the left and right side seal portions 121 and 122 that join the first sheet 111 and the second sheet 112 are provided substantially linearly along left and right ends of the first sheet 111 and the second sheet 112 from the opening portion 130 to the folded portion 150 of the bottom sheet 113. For example, as shown in FIG. 1, the portions 121B and 122B of the left and right side seal portions 121 and 122 that join the facing surfaces of the folded bottom sheet 113 are provided substantially linearly to be along left and right ends of the folded bottom sheet 113 and to be continuous with the portions 121A and 122A of the left and right side seal portions 121 and 122 that join the first sheet 111 and the second sheet 112. Here, the folded portion 150 of the bottom sheet 113 includes a portion in which inner edges 121Aa and 122Aa of the portions 121A and 122A of the left or right side seal portions 121 and 122 in which the first sheet 111 and the second sheet 112 are joined and inner edges 123Aa and 123Ba, or 124Aa and 124Ba of the first or second bottom side seal portions 123A and 123B, or 124A and 124B continuously connected to the portions 121A and 122A in which the first sheet 111 and the second sheet 112 are joined intersect each other. Here, the inner edge is an edge inside the steam dischargeable pouch 100.

The first bottom seal portion 123 includes first left and right bottom side seal portions 123A and 123B, and a substantially linear first bottom intermediate seal portion 123C continuously connected to the first left and right bottom side seal portions 123A and 123B between the first left and right bottom side seal portions 123A and 123B, in a portion where the first sheet 111 and the bottom sheet 113 are joined. Here, the left and right of the first left and right bottom side seal portions 123A and 123B refer to the left and right with respect to the first sheet 111 when the first sheet 111 is the front as shown in FIG. 1.

The first left bottom side seal portion 123A includes a portion obliquely formed from the left side seal portion 121 to the first bottom intermediate seal portion 123C, and the first right bottom side seal portion 123B includes a portion obliquely formed from the right side seal portion 122 to the first bottom intermediate seal portion 123C.

For example, as shown in FIG. 10, the first left and right bottom side seal portions 123A and 123B include portions formed obliquely from each of the left and right side seal portions 121 and 122 to the first bottom intermediate seal portion 123C to be continuous with lower ends of the portions 121A and 122A of the left and right side seal portions 121 and 122 that join the first sheet 111 and the second sheet 112. A lower end of the inner edge 121Aa of the portion 121A of the left side seal portion 121 that joins the first sheet 111 and the second sheet 112 and an upper end of the inner edge 123Aa of the first left bottom side seal portion 123A are continuously connected to each other, and a lower end of the inner edge 122Aa of the portion 122A of the right side seal portion 122 that joins the first sheet 111 and the second sheet 112 and an upper end of the inner edge 123Ba of the first right bottom side seal portion 123B are continuously connected to each other. The inner edges 121Aa and 122Aa of the portions 121A and 122A of the left and right side seal portions 121 and 122 that joins the first sheet 111 and the second sheet 112, and the inner edges 123Aa, 123Ca and 123Ba of the first bottom seal portion 123 define an exterior of an inner portion of the steam dischargeable pouch 100 before opening in a front view.

The second bottom seal portion 124 also has the following structure as in the first bottom seal portion 123. The second bottom seal portion 124 includes second left and right bottom side seal portions 124A and 124B, and a substantially linear second bottom intermediate seal portion 124C continuously connected to the second left and right bottom side seal portions 124A and 124B between the second left and right bottom side seal portions 124A and 124B, at a portion in which the first sheet 111 and the bottom sheet 113 are joined. Here, the left and right sides of the second left and right bottom side seal portions 124A and 124B refer to the left and right sides with respect to the second sheet 112 when the second sheet 112 is a front surface as shown in FIG. 10.

The second left bottom side seal portion 124A includes a portion obliquely formed from the right side seal portion 122 to the second bottom intermediate seal portion 124C, and the second right bottom side seal portion 124B includes a portion obliquely formed from the left side seal portion 121 to the second bottom intermediate seal portion 124C.

For example, as shown in FIG. 1, the second left and right bottom side seal portions 124A and 124B include portions formed obliquely from each of the left and right side seal portions 121 and 122 to the second bottom intermediate seal portion 124C to be continuous with the lower ends of the portions 121A and 122A of the left and right side seal portions 121 and 122 that join the first sheet 111 and the second sheet 112. A lower end of the inner edge 122Aa of the portion 122A of the right side seal portion 122 that joins the first sheet 111 and the second sheet 112 and an upper end of the inner edge 124Aa of the second left bottom side seal portion 124A are continuously connected to each other, and a lower end of the inner edge 121Aa of the portion 121A of the left side seal portion 121 that joins the first sheet 111 and the second sheet 112 and an upper end of the inner edge 124Ba of the second right bottom side seal portion 124B are continuously connected to each other. The inner edges 121Aa and 122Aa of the portions 121A and 122A of the left and right side seal portions 121 and 122 that join the first sheet 111 and the second sheet 112, and the inner edges 124Aa, 124Ca and 124Ba of the second bottom seal portion 124 define an exterior of the inner portion of the steam dischargeable pouch 100 before opening in a front view.

In the steam dischargeable pouch 100 shown in FIGS. 10 and 11, shapes of the first sheet 111 and the second sheet 112 are the same, and a shape of the bottom seal portion 123 that joins the first sheet 111 and the bottom sheet 113 and a shape of the bottom seal portion 124 that joins the second sheet 112 and the bottom sheet 113 are the same. Shapes of the first left bottom side seal portion 123A and the first right bottom side seal portion 123B are bilaterally symmetrical, and shapes of the second left bottom side seal portion 124A and the second right bottom side seal portion 124B are also bilaterally symmetrical.

In the steam dischargeable pouch 100 shown in FIG. 11, the contents 200 are accommodated, the accommodating portion 140 swells, and the folded portion 150 of the bottom sheet 113 is unfolded. The left side seal portion 121 and the right side seal portion 122 are separated from the bottom sheet 113 toward the opening portion 130 in the height direction in the front view. As another example, the left side seal portion 121 and the right side seal portion 122 may be formed in parallel in the height direction.

A1 [mm] in FIG. 10 indicates a length in the width direction from the lower end (h in FIG. 10) of the inner edge 121Ba of the portion 121B of the left side seal portion 121 that joins the facing surfaces of the folded bottom sheet 113 to a virtual vertical line 126 with respect to an outer edge 123Cb or 124Cb of the first or second bottom intermediate seal portion 123C or 124C that includes a portion (i in FIG. 10) in which the inner edge 123Aa or 124Ba of the first or second bottom side seal portion 123A or 124B continuously connected to the left side seal portion 121 and the inner edge 123Ca or 124Ca of the first or second bottom intermediate seal portion 123C or 124C continuously connected to the first or second bottom side seal portion 123A or 124B intersect each other. Here, the outer edge is an edge of the steam dischargeable pouch 100 on the outer side.

On the other hand, A2 [mm] in FIG. 10 indicates a length in the width direction from the lower end (j in FIG. 10) of the inner edge 122Ba of the portion 122B of the right side seal portion 122 that joins the facing surfaces of the folded bottom sheet 113 to a virtual vertical line 126 with respect to an outer edge 123Cb or 124Cb of the first or second bottom intermediate seal portion 123C or 124C that includes a portion (k in FIG. 10) in which the inner edge 123Ba or 124Aa of the first or second bottom side seal portion 123B or 124A continuously connected to the right side seal portion 122 and the inner edge 123Ca or 124Ca of the first or second bottom intermediate seal portion 123C or 124C continuously connected to the first or second bottom side seal portion 123B or 124A intersect each other. The length A1 and the length A2 are equal.

A ratio of the length A1 [mm], the length (B [mm]) of the inner edge 123Ca or 124Ca of the first or second bottom intermediate seal portion 123C or 124C in the width direction, and the length A2 [mm] is 1:1:1 to 1:3:1. The first or second left and right bottom seal portions 123A and 123B, or 124B and 124A does not retreat during a heat treatment in a microwave oven or the like, and the bottom can be opened more widely by setting the ratio of A1 to B to A2 as described above.

A relationship among the length A1 [mm], the length B [mm], the length A2 [mm], the length (C [mm]) in the height direction from the folded portion 50 of the bottom sheet 113 to a lower end of the bottom sheet 113, and the length (D [mm]) of the substantially linear first or second bottom intermediate seal portion 123C or 124C in the height direction is preferably $(A1+B+A2)\times 2 \geq (C-D)\times 3.14\times 2$. This is because, when the maximum outer perimeter of the bottom portion of the accommodating portion 140 is not equal to or greater than a spread of the bottom sheet 113, the portion (i in FIG. 10) in which the inner edge 123Aa or 124Ba of the first or second bottom side seal portion 123A or 124B and the inner edge 123Ca or 124Ca of the first or second bottom intermediate seal portion 123C or 124C continuously connected to the first or second bottom side seal portion 123A or 124B intersect each other may retreat. Here, the lower end of the bottom sheet 113 is the lowest portion of the bottom sheet 113 in the height direction. In FIG. 10, the lower end of the bottom sheet 113 is a lower end of the first or second bottom intermediate seal portion 123C or 124C.

A length (E1 [mm]) of the left side seal portion 121 in the width direction is equal to a length (E2 [mm]) of the right side seal portion 122 in the width direction. At least, when the steam dischargeable pouch 100 is heat-treated and used as a container after opening, the opening is bilaterally symmetrical, which makes it easier to eat.

Further, the steam dischargeable pouch 100 includes a steam discharge portion (a steam discharge seal portion) 160 that releases steam generated from the contents 200 and the like. The steam discharge portion 160 is configured to open with an increase in pressure of the accommodating portion 140 in a state in which the closed seal portion 125 is formed, such that steam from the contents 200 and the like can be released to the outside. A shape of the steam discharge portion 160 can take various shapes. For example, the steam discharge portion 160 constitutes a part of any one of the left and right side seal portions 121 and 122 or both of them. The steam discharge portion 160 may be an inner portion of the first sheet 111 or the second sheet 112 independently of the left or right side seal portions 121 or 122. The steam discharge portion 160 shown in FIG. 10 has a seal portion having a shape recessed from the outside to the inside in the width direction in a part of the portions 121A and 122A that join the first sheet 111 and the second sheet 112 in the right side seal portion 122. Seal strength of the seal portion having a shape recessed from the outside to the inside in the width direction is weaker than that of a side seal portion continuously connected to the seal portion and functions as a steam discharge region. As will be described below, the steam discharge region is a region that serves as a passage for discharging steam when the steam is released, and may be an unsealed region as in the case of the first embodiment. A tip end portion of the steam discharge portion 160 that is the innermost portion in the width direction is provided at a place in each of the first sheet 111 and the second sheet 112 at which strong application concentration occurs when the pressure of the accommodating portion 140 increases. When the pressure of the accommodating portion 140 increases to a pressure within a predetermined pressure range, the steam discharge portion 160 opens. Specifically, as the pressure of the accommodating portion 140 increases, the first sheet 111 and the second sheet 112 joined at the tip end portion of the steam discharge portion 160 are peeled off, and a steam discharge passage that connects the accommodating portion 140 and the outside is formed in the steam discharge portion 160. Steam is released by heating in a microwave oven or the like, the pressure increase in the accommodating portion 140 is suppressed, and the burst of the steam dischargeable pouch 100 is avoided.

An opening guide portion 70 is formed in a part of the left or right side seal portions 121 or 122. The opening guide portion 170 is provided between the steam discharge portion 160 and the folded portion 150 of the bottom sheet 113. When the closed steam dischargeable pouch 100 is heated, a portion of the first sheet 111 or the second sheet 112 between the steam discharge portion 160 and the bottom sheet 113 in the height direction greatly swells due to steam generated from the contents 200 and the like. The contents 200 can be easily taken out while a wider opening width is maintained by tearing the greatly swelled portion of the first sheet 111 or the second sheet 112. The opening guide portion 170 is preferably formed at a position close to the steam discharge portion 160 in the height direction. This is because a large amount of contents 200 can be accommodated in the accommodating portion 140. In FIG. 10, the opening guide portion 170 is formed only at the left side seal portion 121, but may be formed only at the right side seal portion 122 or at both the left and right side seal portions 121 and 122.

The relationship between the length C [mm] and the length (F [mm]) in the height direction from the opening guide portion 170 to the lower end of the bottom sheet 113 is preferably $C \times 2 \leq F$ in consideration of a balance between an opening width and a liquid level height of the contents.

As shown in FIG. 10, the opening guide portion 170 may be, for example, a cutout having a triangular shape that narrows toward the inner edge 121Aa of the left side seal portion 121. In FIG. 10, a tab portion 171 is also provided to sandwich the opening guide portion 170. The opening guide portion 170 may be, for example, a notch, a cut, or the like, in addition to the cutout shown in FIG. 10.

Further, an opening guide line such as a perforation starting from the opening guide portion 170 may be provided. The opening guide line is formed horizontally, for example, starting from the opening guide portion 170 formed at one side seal portion and reaching the other side seal portion. The largely swelled portion of the first sheet 111 and the second sheet 112 can be easily torn along the opening guide line, and the contents 200 can be easily taken out.

When the steam dischargeable pouch is configured of one sheet, it is not necessary to provide the first and second bottom intermediate seal portions. In this case, it is as follows.

The first bottom intermediate seal portion 123C is not provided at the first bottom seal portion, and only the first left and right bottom side seal portions are included.

The first left bottom side seal portion includes a portion formed obliquely from the left side seal portion 121 to the lower end of the bottom sheet 113, and the first right bottom side seal portion includes a portion formed obliquely from the right side seal portion 122 to the lower end of the bottom sheet 113.

The first left and right bottom side seal portions include, for example, a portion obliquely formed from each of the left and right side seal portions 121 and 122 toward the lower end of the bottom sheet 113 to be continuous with the lower ends of the portions 121A and 122A of the left and right side seal portions 121 and 122 that join the first sheet 111 and the second sheet 112. The inner edges 121Aa and 122Aa of the portions 121A and 122A of the left and right side seal portions 121 and 122 that join the first sheet 111 and the second sheet 112, and the inner edges of the first bottom seal portion 123 and the lower end of the bottom sheet 113 define an exterior of an inner portion of the steam dischargeable pouch 100 before opening in a front view.

The second bottom seal portion 124 also has the following structure, as in the first bottom seal portion 123. The second bottom seal portion is provided with the second bottom intermediate seal portion 124C is not provided at the second bottom seal portion and only the second left and right bottom side seal portions.

The second left bottom side seal portion includes a portion formed obliquely from the right side seal portion 122 to the lower end of the bottom sheet 113, and the second right bottom side seal portion includes a portion formed obliquely from the left side seal portion 121 to the lower end of the bottom sheet 113.

The second left and right bottom side seal portions include, for example, a portion obliquely formed from each of the right and left side seal portions 122 and 121 toward the lower end of the bottom sheet 113 to be continuous with the lower ends of the portions 122A and 121A of the left and right side seal portions 122 and 121 that join the first sheet 111 and the second sheet 112. The inner edges 122Aa and 121Aa of the portions 122A and 121A of the right and left side seal portions 122 and 121 that join the first sheet 111 and the second sheet 112, and the inner edges of the second bottom seal portion 124 and the lower end of the bottom sheet 113 define the exterior of the inner portion of the steam dischargeable pouch 100 before opening in a front view.

Even when the first and second bottom intermediate seal portions 123C and 124C are not provided as described above, in the steam dischargeable pouch, the shapes of the first sheet 111 and the second sheet 112 are the same, and the shape of the bottom seal portion 123 that joins the first sheet 111 and the bottom sheet 113 and the shape of the bottom seal portion 124 that joins the second sheet 112 and the bottom sheet 113 are the same. Further, the shapes of the first left bottom side seal portion and the first right bottom side seal portion are bilaterally symmetrical, and the shapes of the second left bottom side seal portion and the second right bottom side seal portion are also bilaterally symmetrical.

A length in the width direction from the lower end of the inner edge 121Ba of the portion 121B of the left side seal portion 121 that joins the facing surfaces of the folded bottom sheet 113 to a virtual vertical line with respect to the lower end of the bottom sheet 113 that includes the portion in which the inner edge of the first or second bottom side seal portion continuously connected to the left side seal portion 121 and the lower end of the bottom sheet 113 intersect each other is A3 [mm].

A length in the width direction from the lower end of the inner edge 122Ba of the portion 122B of the right side seal portion 122 that joins the facing surfaces of the folded bottom sheet 113 to a virtual vertical line with respect to the lower end of the bottom sheet 113 including the portion in which the inner edge of the first or second bottom side seal portion continuously connected to the right side seal portion 122 and the lower end of the bottom sheet 113 intersect each other is A4 [mm].

Further, a length in the width direction between a portion in which the first left bottom side seal portion and the lower end of the bottom sheet 113 intersect and a portion in which the first right bottom side seal portion and the lower end of the bottom sheet 113 intersect, or between a portion in which the second left bottom side seal portion and the lower end of the bottom sheet 113 intersect and a portion in which the second right bottom side seal portion and the lower end of the bottom sheet 113 intersect is B1 [mm].

The ratio of A3 [mm] to B1 [mm] to A4 [mm] is 1:1:1 to 1:3:1. The first or second left and right bottom seal portions do not retreat during heat treatment in a microwave oven or the like, and the bottom can be opened more widely by setting the ratio of A3 [mm] to B1 [mm] to A4 [mm] as described above.

The relationship among A3 [mm], B1 [mm], A4 [mm], and the length (C [mm]) in the height direction from the folded portion 150 of the bottom sheet 113 to the lower end of the bottom sheet 113 is preferably $(A1+B+A2)\times 2 \geq C\times 3.14\times 2$. This is because, when the maximum outer perimeter of the bottom portion of the accommodating portion 140 is not equal to or greater than a spread of the bottom sheet 113, the portion in which the first or second left bottom side seal portion and the lower end of the bottom sheet 113 intersect, or the portion in which the first or second right bottom side seal portion and the lower end of the bottom sheet 113 intersect may retreat. Here, the lower end of the bottom sheet 113 is the lowest portion of the bottom sheet 113 in the height direction.

Each of the first sheet 111, the second sheet 112, and the bottom sheet 113 has a layer structure in which a plurality of layers are laminated. The layer structure of each of the above sheets 111 to 113 can be arbitrarily selected. Each of the sheets 111 to 113 may have the same layer structure, or the bottom sheet 113 may have a different layer structure from the first sheet 111 or the second sheet 112 while the first sheet 111 and the second sheet 112 have the same layer structure, and each of the sheets 111 to 113 may have a different layer structure. The sheets 111 to 113 of the steam dischargeable pouch 100 shown in FIG. 10 all have the same layer structure.

Each of the sheets 111 to 113 includes, for example, an outermost layer, an intermediate layer, a sealant layer, a first adhesive layer, and a second adhesive layer. Each of the sheets 111 to 113 can be manufactured by, for example, a dry laminating method, an extruder method, a thermal laminating method, or the like. The first adhesive layer is provided between the outermost layer and the intermediate layer to bond the outermost layer and the intermediate layer. The second adhesive layer is provided between the intermediate layer and the sealant layer to bond the intermediate layer and the sealant layer. As in the case of the first embodiment, the first adhesive layer and the second adhesive layer may be regarded as a part of the intermediate layer.

In the steam dischargeable pouch 100, the outermost layer is mainly excellent in gas blocking property, printing suitability, and heat resistance. The outermost layer is, for example, a transparent vapor deposition layer. An example of a material that constitutes the outermost layer is transparent vapor deposition PET as in the case of the first embodiment. The intermediate layer is mainly excellent in heat resistance and moisture resistance. An example of a material that constitutes the intermediate layer is nylon. In a more preferable example, the material that constitutes the intermediate layer is nylon having excellent tearability in a flow direction of a resin (hereinafter, referred to as "linearly cuttable NY"). Hereinafter, the flow direction of the resin of the material that constitutes the first sheet 111 and the second sheet 112 is referred to as a machine direction (MD), and a direction orthogonal to the MD is referred to as a transverse direction (TD). The MD of the first sheet 111 and the second sheet 112 is a direction along the width direction. The TD of the first sheet 111 and the second sheet 112 is a direction along the height direction. An example of a material that constitutes the first adhesive layer is a polyester-based adhesive. An example of a material that constitutes the second adhesive layer is a polyester-based adhesive.

The sealant layer has excellent heat resistance, heat sealability, and impact resistance. An example of a material that constitutes the sealant layer is non-oriented polypropylene having excellent tearability in the MD (hereinafter referred to as "linearly cuttable CPP"). The excellent tearability in the MD means, for example, a case in which a tearing force according to a Trouser tearing method specified in JIS standard K7128-1 is 1.2 N or less. In the trouser tearing method, a cutout of 75 mm was made in a center of a rectangular test piece having a length of 50 mm in the TD and a length of 150 mm in the MD, and a tearing force in the MD was measured at a speed of 200 mm/min in a constant temperature room at 23° C. The linearly cuttable CPP contains, for example, 3 to 10 parts by weight of a low crystalline ethylene-based elastomer with respect to 100 parts by weight of a propylene/ethylene block copolymer. The low crystalline ethylene-based elastomer has, for example, a density in the range of 0.865 to 0.890 g/cm$^3$, and an endothermic quantity at the time of melting defined in JIS standard K7122 in the range of 5 to 30 J/g.

Examples of use of the steam dischargeable pouch 100 are as follows.

In the steam dischargeable pouch 100 containing food as the contents 200, for example, a microwave oven is used to heat the contents 200. As the pressure of the accommodating portion 140 increases, the steam discharge portion 160 opens, the steam generated from the contents 200 and the like is released to the outside from the steam discharge portion 160, thus the pressure increase of the accommodating portion 140 is suppressed, and the burst of the steam dischargeable pouch 100 is avoided. After the heat treatment, the tab portion 171 sandwiched between the opening guide portions 170 formed on the left side seal portion 121 is held, and opening is performed from the opening guide portion 170. Since a bottom spreading property is improved due to predetermined dimensions of the bottom seal portions 123 and 124, the sheets 111 and 112 are torn in a state in which the first sheet 111 and the second sheet 112 are more separated from each other, and thus it is necessary to increase tearing strength. However, since the first sheet 111 and the second sheet 112 include a sealant layer made of a material having excellent tearability in the MD as described above, the first sheet 111 and the second sheet 112 can still be easily torn even when the accommodating portion 140 expands. The steam dischargeable pouch 100 is separated into upper and lower parts by tearing the first sheet 111 and the second sheet 112, a portion of the lower portion of the steam dischargeable pouch 100 that includes the bottom sheet 113 can be used as a container to easily take out the food as the contents 200. Further, since the bottom spreading property is improved by the predetermined dimensions of the bottom seal portions 123 and 124, an opening property at the time of opening is also improved, and it becomes easy to eat the food accommodated as it is after opening.

The pouch 10B (FIG. 12) in which the penetration portion 48 described in the first embodiment is formed in the steam dischargeable pouch 100 further has the same operation and effect as the pouch 10 due to the penetration portion 48 being formed.

Next, an experimental example regarding the steam dischargeable pouch 100 will be described.

1. Evaluation Test of Bottom Spreading Property and the Like Regarding Formation of Bottom Seal Portion The steam dischargeable pouch 100 shown in FIG. 10 was used for both Experimental examples 3A to 5A and Comparative experimental examples 1A to 7A below. The steam dischargeable pouch 100 contained 100 g of curry as the contents 200 and was heat-treated at 600 W for 1 minute by a microwave oven. Further, in both Experimental examples 3A to 5A and Comparative experimental examples 1A to 7A described below, the first sheet 111, the second sheet 112 and the bottom sheet 113 all have the same layer structure, and the layer structure of each of the sheets includes a layer structure of transparent vapor deposition PET (polyethylene terephthalate with an inorganic thin film deposited) (12 μm)/polyethylene terephthalate (12 μm)/heat-resistant non-oriented polypropylene (linearly cuttable CPP) (60 μm) from the outermost layer side. Further, in both Experimental examples 3A to 5A and Comparative experimental examples 1A to 7A, the steam dischargeable pouch 100 having a maximum length of 158 mm in the height direction in the front view and a maximum length of 150 mm in the width direction in the front view was used.

Experimental Example 3A

A steam dischargeable pouch 100 was used in which B, A1 and A2 were all equally 44.66 mm, E1 and E2 were equally 8 mm, and a difference between C and D (C−D) was 85 mm.

Experimental Example 4A

A steam dischargeable pouch 100 was used in which B was 67 mm, A1 and A2 were equally 33.5 mm, E1 and E2 were equally 8 mm as in Example 1, and the difference between C and D (C−D) was 85 mm as in Experimental example 3A.

Experimental Example 5A

A steam dischargeable pouch 100 was used in which B was 80.4 mm, A1 and A2 were equally 26.8 mm, E1 and E2 were equally 8 mm as in Example 1, and the difference between C and D (C−D) was 85 mm as in Experimental example 3A.

Comparative Experimental Example 1A

A steam dischargeable pouch 100 was used in which B, A1 and A2 were all equally 44.66 mm as in Experimental example 3A, E1 was 8 mm as in Experimental example 3A, E2 was 6 mm, and the difference between C and D (C−D) was 85 mm as in Experimental example 3A.

Comparative Experimental Example 2A

A steam dischargeable pouch 100 was used in which, in the case of B, A1 and A2, B was 67 mm and A1 and A2 were equally 33.5 mm as in Experimental example 4A, E1 was 8 mm as in Experimental example 3A, E2 was 6 mm, and the difference between C and D (C−D) was 85 mm as in Experimental example 3A.

Comparative Experimental Example 3A

A steam dischargeable pouch 100 was used in which, in the case of B, A1 and A2, B was 80.4 mm and A1 and A2 were equally 26.8 mm as in Experimental example 5A, E1 was 8 mm as in Experimental example 3A, E2 was 6 mm, and the difference between C and D (C−D) was 85 mm as in Experimental example 3A.

Comparative Experimental Example 4A

A steam dischargeable pouch 100 was used in which B was 26.8 mm, A1 and A2 were equally 53.6 mm, E1 and E2 were equally 8 mm as in Experimental example 3A, and the difference between C and D (C−D) was 85 mm as in Experimental example 3A.

Comparative Experimental Example 5A

A steam dischargeable pouch 100 was used in which B was 89.33 mm, A1 and A2 were equally 22.33 mm, E1 and E2 were equally 8 mm as in Experimental example 3A, and the difference between C and D (C−D) was 85 mm as in Experimental example 3A.

Comparative Experimental Example 6A

A steam dischargeable pouch 100 was used in which B was 134 mm, A1 and A2 were equally 0 mm, E1 and E2 were equally 8 mm as in Experimental example 3A, and the difference between C and D (C−D) was 85 mm as in Experimental example 3A.

Comparative Experimental Example 7A

A steam dischargeable pouch 100 was used in which B was 0 mm, A1 and A2 were equally 67 mm, E1 and E2 were equally 8 mm as in Experimental example 3A, and the difference between C and D (C−D) was 85 mm as in Experimental example 3A.

Evaluation

"Presence/absence of retreat of the first or second left and right bottom seal portions 123A and 123B, or 124B and 124A during heat treatment" (described as "presence/absence of retreat of left and right bottom seal portions in Table 3"), "bottom spreading property after heat treatment" (described as "bottom spreading property" in Table 3) and "opening width after opening" (described as "opening width" in Table 1) were evaluated using the above-described Experimental examples 3A to 5A and Comparative experimental examples 1A to 7A. The results thereof are shown in Table 3. In Table 3, when the first or second left and right bottom seal portions 123A and 123B, or 124B and 124A did not retreat in the "presence or absence of retreat of the left and right bottom seal portions," it was described as "absence", and when the retreat of the first or second left and right bottom seal portions 123A and 123B, or 124B and 124A occurred, it was described as "presence" (when the retreat occurred slightly, it was described as "slight presence"). Further, in Table 3, when the bottom spreading property was good, it was described as "+", when the bottom spreading property is in an edible state but is not sufficient, it was described as "$-^{+}$", and when the bottom spreading property was poor, it was described as "−". The "opening width after opening" is the maximum opening width at the time of opening after opening.

In the "comprehensive evaluation" in Table 3, when the first or second left and right bottom seal portions 123A and 123B, or 124B and 124A did not retreat and the bottom spreading property was good, it was described as "+", when the first or second left and right bottom seal portions 123A and 123B, or 124B and 124A retreated, or the bottom spreading property was insufficient ($-^{+}$) or poor (−), it was described as "−".

and 124A retreated during the heat treatment in the microwave oven, and the bottom spreading property was poor. The opening widths of Comparative experimental examples 1A to 7A are as shown in Table 3.

From the above-described evaluation results, the comprehensive evaluation was "+" for all of Experimental examples 3A to 5A and "−" for all of Comparative experimental examples 1A to 7A.

Regarding the formation of the bottom seal portion, as described above, the ratio of A1 to B to A2 is included in the range of 1:1:1 to 1:3:1 in Experimental examples 3A to 5A and Comparative experimental examples 1A to 3A. On the other hand, in Comparative experimental examples 4A to 7A, the ratio A1 to B to A2 is not included in the range of

TABLE 3

| | Experimental example 3A | Experimental example 4A | Experimental example 5A | Comparative experimental example 1A | Comparative experimental example 2A | Comparative experimental example 3A | Comparative experimental example 4A | Comparative experimental example 5A | Comparative experimental example 6A | Comparative experimetal example 7A |
|---|---|---|---|---|---|---|---|---|---|---|
| B [mm] | 44.66 | 67 | 80.4 | 44.66 | 67 | 80.4 | 26.8 | 89.33 | 134 | 0 |
| A1 [mm] | 44.66 | 33.5 | 26.8 | 44.66 | 33.5 | 26.8 | 53.6 | 22.33 | 0 | 67 |
| A2 [mm] | 44.66 | 33.5 | 26.8 | 44.66 | 33.5 | 26.8 | 53.6 | 22.33 | 0 | 67 |
| E1 [mm] | 8 | 8 | 8 | 8 | 8 | 8 | 8 | 8 | 8 | 8 |
| E2 [mm] | 8 | 8 | 8 | 6 | 6 | 6 | 8 | 8 | 8 | 8 |
| C-D [mm] | 85 | 85 | 85 | 85 | 85 | 85 | 85 | 85 | 85 | 85 |
| Presence or absence of retreat of the left and right bottom seal portions | Absence | Absence | Absence | Absence | Absence | Absence | Slight presence | Presence | Presence | Presence |
| Spreading property | + | + | + | $-^{+}$ | $-^{+}$ | $-^{+}$ | + | + | $-^{+}$ | − |
| Opening width [mm] | 90 | 100 | 90 | 90 | 103 | 93 | 93 | 105 | 95 | 50 |
| Comprehensive evaluation | + | + | + | − | − | − | − | − | − | − |

As a result of the evaluation, in Experimental examples 3A to 5A, the first or second left and right bottom seal portions 123A and 123B, or 124B and 124A did not retreat during the heat treatment in the microwave oven, and the bottom spreading property was good. The opening width in each of Experimental examples 3A and 5A was 90 mm, and the opening width in Experimental example 4A was 100 mm. On the other hand, in Comparative experimental examples 1A to 3A, although the first or second left and right bottom seal portions 123A and 124B, or 123B and 124A did not retreat during the heat treatment in the microwave oven, the bottom spreading property was in the edible state but was not sufficient. In Comparative experimental example 4A, the first or second left and right bottom seal portions 123A and 123B, or 124B and 124A slightly retreated during the heat treatment in the microwave oven, and the bottom spreading property was good. In Comparative experimental example 5A, the first or second left and right bottom seal portions 123A and 123B, or 124B and 124A retreated during the heat treatment in the microwave oven, and the bottom spreading property was good. In Comparative experimental example 6A, the first or second left and right bottom seal portions 123A and 123B, or 124B and 124A retreated during the heat treatment in the microwave oven, and the bottom spreading property was in the edible state but was not sufficient. In Comparative experimental example 7A, the first or second left and right bottom seal portions 123A and 123B, or 124B 1:1:1 to 1:3:1. E1 and E2 are equal in Experimental examples 3A to 5A and Comparative experimental examples 4A to 7A, but E1 and E2 are different from each other in Comparative experimental examples 1A to 3A.

Therefore, when the ratio of A1 to B to A2 is included in the range of 1:1:1 to 1:3:1, and E1 and E2 are equal, it can be seen that the comprehensive evaluation is "+", that is, the first or second left and right bottom seal portions 123A and 123B, or 124B and 124A do not retreat when heated in the microwave oven, and the bottom is spread more widely. It is necessary that the opening width and the bottom spreading property are compatible.

2. Evaluation Test of Cutting Property and the Like Regarding Position of Opening Guide Portion In both Experimental examples 3B to 5B and Comparative experimental examples 1B and 2B below, a steam dischargeable pouch having an opening guide line such as a perforation starting from the opening guide portion 170 of the steam dischargeable pouch 100 shown in FIG. 10 was used. The opening guide line is formed horizontally to start from the opening guide portion 170 formed in the left side seal portion 121 and to reach the right side seal portion 122.

The steam dischargeable pouch containing 100 ml of water as the contents 200 was heat-treated at 600 W for 1 minute and 40 seconds in a microwave oven. In both Experimental examples 3B to 5B and Comparative experimental examples 1B and 2B below, the first sheet 111, the second sheet 112 and the bottom sheet 113 all have the same layer structure, and the layer structure of each of the sheets 111 to 113 includes a layer structure of a gas-barrier alumina-deposited polyethylene terephthalate film (using "GL-ARH" manufactured by Toppan Printing Co., Ltd.) (12 μm)/linearly cuttable property NY (15 μm)/non-oriented polypropylene (linearly cuttable property CPP) (manufactured by Toray Film Processing Co., Ltd. (using "ZK500R") (60 μm) from the outermost layer side.

In both Experimental examples 3B to 5B and Comparative experimental examples 1B and 2B, a steam dischargeable pouch in which the maximum length in the height direction in the front view is 158 mm, the maximum length in the width direction in the front view is 140 mm, the steam discharge portion 160 forming a part of the right side seal portion 122 is formed at a position in which a length in the height direction from an upper end of an outer edge of the right side seal portion 122 is 58 mm, and a height (C) from the folded portion 150 of the bottom sheet 113 to the lower end of the bottom sheet is 45 mm was used. In both Experimental examples 3B to 5B and Comparative experimental examples 1B and 2B, the opening guide portion 70 is formed in the left side seal portion 121, but the positions of the opening guide portion 170 are different in each of the examples. In Table 4, the "position of the opening guide portion" indicates the length (F) in the height direction from the opening guide portion 70 to the lower end of the bottom sheet 113.

Experimental Example 3B

A steam dischargeable pouch 100 in which an opening guide portion 170 is located at a position of 90 mm was used.

Experimental Example 4B

A steam dischargeable pouch 100 in which an opening guide portion 170 is located at a position of 80 mm was used.

Experimental Example 5B

A steam dischargeable pouch 100 in which an opening guide portion 170 is located at a position of 72 mm was used.

Comparative Experimental Examples 1B

A steam dischargeable pouch 100 in which an opening guide portion 170 is located at a position of 70 mm was used.

Comparative Experimental Examples 2B

A steam dischargeable pouch 100 in which an opening guide portion 170 is located at a position of 60 mm was used.

Evaluation

"Opening width in top view immediately after heat treatment and then opening, and opening width in top view 10 minutes after heat treatment and then opening", "cutting property at the time of opening after heat treatment" (described as "cutting property" in Table 4), "risk of burn when the contents 200 is taken out" (described as "risk of burn" in Table 4), and "easy to load and unload a container when the steam dischargeable pouch 100 is used as the container after opening" (described as "loading and unloading of the container" in Table 4) were evaluated using the above-described Experimental examples 3B to 5B and Comparative experimental examples 1B and 2B.

The results thereof are shown in Table 4. The above-described "cutting property" indicates whether or not the first sheet 111 and the second sheet 112 are easily torn. In Table 4, regarding "cutting property", when the first sheet 111 and the second sheet 112 could be easily torn, it was described as "easy", when the first sheet 111 and the second sheet 112 could be torn but it was not easy, it was described as "possible", and when the first sheet 111 and the second sheet 112 could be torn but it was difficult, it was described as "difficult". Regarding the "risk of burn" in Table 4, when the risk of burn was low while the contents 200 were taken out of the steam dischargeable pouch 100 after the heat treatment, it was described as "low", when there is a slight risk of burn while the contents 200 were taken out of the steam dischargeable pouch 100 after the heat treatment, it was described as "slight presence", and when the risk of burn was high while the contents 200 were taken out of the steam dischargeable pouch 100 after the heat treatment, it was described as "high". Regarding the "loading and unloading of container" in Table 4, when the steam dischargeable pouch 100 was used as a container after the heat treatment and then opening, and the container is easily loaded and unloaded, it was described as "easy", and when the steam dischargeable pouch 100 was used as a container after the heat treatment and then opening, and the container is not easily loaded and unloaded but it is possible, it was described as "possible".

In the "comprehensive evaluation" in Table 4, when it was easy to eat because cutting property was easy, the risk of burn was low, and the container could be easily loaded and unloaded, it was described as "+", when eating was inconvenient but possible, it was described as and when it was impossible to eat, it was described as

TABLE 4

| | Experimental example 3B | Experimental example 4B | Experimental example 5B | Comparative experimental example 1B | Comparative experimental example 2B |
|---|---|---|---|---|---|
| Position (F) of opening guide portion | 90 mm | 80 mm | 72 mm | 70 mm | 60 mm |
| Length (C) in height direction from folded portion of bottom sheet to lower end of bottom sheet | 45 mm | 45 mm | 45 mm | 45 mm | 45 mm |

TABLE 4-continued

| | Experimental example 3B | Experimental example 4B | Experimental example 5B | Comparative experimental example 1B | Comparative experimental example 2B |
|---|---|---|---|---|---|
| Opening width in top view immediately after heat treatment and then opening | 87 mm | 79 mm | 75 mm | 75 mm | 85 mm |
| Opening width in top view 10 minutes after heat treatment and then opening | 85 mm | 82 mm | 82 mm | 85 mm | 81 mm |
| Cutting property | Easy | Easy | Possible~difficult | Difficult | Difficult |
| Risk of burn | Low | Low | Slight presence | High | High |
| Loading and unloading of container | Possible | Possible~easy | Easy | Easy | Easy |
| Comprehensive evalution | $-^{+}$ | + | $-^{+}$ | − | − |

As a result of the evaluation, in Experimental example 4B, the cutting property was easy, the risk of burn was low, and the container could be easily loaded and unloaded. On the other hand, in Experimental example 3B, the cutting property was easy, the risk of burn was low, and the container could be loaded and unloaded. In Experimental example 5B, the cutting property was possible or easy, the risk of burn was slightly present, and the container was easily loaded and unloaded. In both Comparative experimental examples 1B and 2B, the cutting property was difficult, the risk of burn was high, and the container was easily loaded and unloaded.

From the above-described evaluation results, the comprehensive evaluation was "+" for Experimental example 4B, "$-^{+}$" for Experimental examples 3B and 3B, and "−" for Comparative experimental examples 1B and 2B.

As can be seen from the above description and Table 4, as the position of the opening guide portion 170 provided between the steam discharge portion 60 and the folded portion 150 of the bottom sheet 113 is closer to the upper end of the side seal portion 121 with respect to the length in the width direction of the steam dischargeable pouch 100, difficulty of the cutting property of the first sheet 111 and the second sheet 112 decreases, and also, since heat or steam of the contents 200 is less likely to hit the hand when the contents 200 is taken out, the risk of burn is reduced. However, when the position of the opening guide portion 170 is too high with respect to the length in the width direction of the steam dischargeable pouch 100, the steam dischargeable pouch 100 tends to bend and is not suitable as a container. On the other hand, as the position of the opening guide portion 70 provided between the steam discharge portion 160 and the folded portion 50 of the bottom sheet 113 is low with respect to the he length in the width direction of the steam dischargeable pouch 100, that is, is closer to the lower end of the side seal portion 121, the difficulty of the cutting property of the first sheet 111 and the second sheet 112 increases, and the heat and steam of the contents 200 are more likely to hit the hand when the contents 200 is taken out, and thus the risk of burn increases. As the position of the opening guide portion 170 is lower with respect to the length in the width direction of the steam dischargeable pouch 100, the steam dischargeable pouch 100 is unlikely to bend and thus is stable, which making it suitable as a container. Therefore, it was confirmed that there is a trade-off relationship between the cutting property and usability as a container.

In this way, due to the steam dischargeable pouch described in the second embodiment, the bottom spreading property is improved by making the lengths (A1 and A2) of the left and right bottom side seal portions equal to each other in the width direction, and setting the ratio of the length (A1) of the bottom side seal portion in the width direction, the length (B) of the inner edge of the bottom intermediate seal portion in the width direction, and the length (A2) of the bottom side seal portion in the width direction to 1:1:1 to 1:3:1.

When the closed steam dischargeable pouch is heat-treated in a microwave oven, or the like, the internal pressure increases due to the steam generated from the contents, and the accommodating portion swells greatly, but bursting of the steam dischargeable pouch can be avoided by releasing the steam from the steam discharge portion.

Furthermore, since the opening property at the time of opening after the heat treatment is also improved by improving the bottom spreading property, the contents can be easily taken out, and it becomes easy to eat the food as it is from the steam dischargeable pouch using the steam dischargeable pouch as a container without transferring it to tableware.

The present invention is not limited to the above-described first and second embodiments and experimental examples, and is intended to include the scope indicated by the claims and to include all modifications within the meaning and scope equivalent to the claims.

For example, in the pouch 10 of the first embodiment, the sheets 16 and 18 may be made of a material containing no polyamide, and the sheet 20 constituting the bottom portion may be made of a material containing polyamide. For example, the materials of the intermediate layer (the main body) and the innermost layer (the sealant layer) in the sheet 20 constituting the bottom portion 12 of the pouch 10 may be different from those of the sheets 16 and 18. In one embodiment, the intermediate layer (the main body layer) of the sheet 20 may be formed of non-oriented nylon so that the opening portion widely and easily opens when the pouch 10 is opened using the pair of notches n2 shown in FIG. 1. The intermediate layer (the main body) of the sheet 20 does not have to be easy to tear (easy to cut). The innermost layer (the sealant layer) of the sheet 20 may be made of a material having excellent heat resistance and bottom spreading property. In one embodiment, the innermost layer (the sealant layer) of the sheet 20 has excellent heat resistance, heat sealability, and flexibility. In one embodiment, the innermost layer (the sealant layer) of the sheet 20 is made of a non-oriented film (for example, non-oriented polypropylene) and has a property of stretching when pulled, but does not have to be easy to tear (easy to cut). When the materials of the sheets 16 and 18 and the sheet 20 are different like steam, the pouch 10 may be formed by, for example, separate sheets 16, 18 and 20 from each other. Although the case of the first embodiment has been described as an example, the same applies to the bottom sheet 13 of the steam dischargeable pouch 100 in the second embodiment.

In the example of the first embodiment, in the steam discharge seal portion 34, a length (corresponding to the length L10 in FIG. 7) of a portion that protrudes inward of the pouch 10 with respect to the side seal portion 28 may be shorter than a width (corresponding to the seal width W3 in FIG. 7) of the side seal portion 28 (particularly, the lower seal portion 32). In this case, the steam discharge seal portion 34 is likely to be closed when heating and cooking of the pouch 10 is ended. Although the case of the first embodiment has been described as an example, the same applies to the steam discharge portion 160 of the steam dischargeable pouch 100 in the second embodiment.

The sheet constituting the pouch (particularly, the sheet constituting the body of the pouch) may be a laminate in which a sealant layer as the innermost layer, a polyester layer adjacent to the sealant layer and having a printing layer on a surface on the side opposite to the sealant layer, a colored polyester layer containing an inorganic pigment and a printing base material as the outermost layer are laminated in this order. In this case, double-sided printing is possible, and decorativeness of the pouch can be improved.

Various embodiments, modifications, and the like illustrated can be combined with each other without departing from the spirit of the present invention.

REFERENCE SIGNS LIST

10, 10B Pouch
12 Bottom portion
14 Top portion
16, 18 Pair of sheets
26, 28 Pair of side seal portions
30 Upper seal portion
32 Lower seal portion
34 Steam discharge seal portion
36 Tip end portion
46 Un sealed region
46*a* First region
46*b* Second region
48 Penetration portion
50*a* Virtual line (first virtual line)
50*b* Virtual line (second virtual line)
52, 54, 56 Penetration portion
100 Steam dischargeable pouch
111 First sheet (one of a pair of sheets)
111A Bottom portion of first sheet
112 Second sheet (the other one of a pair of sheets)
111A Bottom portion of second sheet
113 Bottom sheet
121 Left side seal portion (one of a pair of side seal portions)
121A Portion of left side seal portion that joins first sheet and second sheet
121Aa Inner edge of portion of left side seal portion that joins first sheet and second sheet
121B Portion of left side seal portion that joins facing surfaces of folded bottom sheet
121Ba Inner edge of portion of left side seal portion that joins facing surfaces of folded bottom sheet
121Bb Outer edge of portion of left side seal portion that joins facing surfaces of folded bottom sheet
122 Right side seal portion (the other one of a pair of side seal portions)
122A Portion of right side seal portion that joins first sheet and second sheet
122Aa Inner edge of portion of right side seal portion that joins first sheet and second sheet
122B Portion of right side seal portion that joins facing surfaces of folded bottom sheet
122Ba Inner edge of portion of right side seal portion that joins facing surfaces of folded bottom sheet
122Bb Outer edge of portion of right side seal portion that joins facing surfaces of folded bottom sheet
123 First bottom seal portion
123A First left bottom side seal portion
123Aa Inner edge of first left bottom side seal portion
123B First right bottom side seal portion
123Ba Inner edge of first right bottom side seal portion
123C First bottom intermediate seal portion
123Ca Inner edge of first bottom intermediate seal portion
123Cb Outer edge of first bottom intermediate seal portion
124 Second bottom seal portion
124A Second left bottom side seal portion
124Aa Second left bottom side seal portion
124B Second right bottom side seal portion
124Ba Inner edge of second right bottom side seal portion
124C Second bottom intermediate seal portion
124Ca Inner edge of second bottom intermediate seal portion
124Cb Outer edge of second bottom intermediate seal portion
125 Closed seal portion
126 Virtual vertical line with respect to outer edge of first or second bottom intermediate seal portion
130 Opening portion
140 Accommodation portion
150 Folded portion of bottom sheet
160 Steam discharge portion
170 Opening guide portion
171 Tab portion
200 Contents
C Center
S Accommodation space

The invention claimed is:

1. A pouch having an accommodation space that accommodates contents between a bottom portion and a top portion on a side opposite to the bottom portion, comprising:
a pair of sheets that are aligned one over another; and
a pair of side seal portions provided on both sides of the pair of sheets to be sealed so that the pair of sheets form the accommodation space,
wherein at least one side seal portion of the pair of side seal portions includes
a first seal portion located closer to the top portion,
a second seal portion located closer to the bottom portion than the first seal portion and separated from the first seal portion, and a steam discharge seal portion configured to connect the first seal portion and the second seal portion, to protrude to a side of the accommodation space, and to release steam, a steam discharge region to allow passage of the steam, the steam discharge region formed by a first region between the first seal portion and the second seal portion and a second region surrounded by the first region and the steam discharge seal portion, so that the steam discharge seal portion is located closer to the top portion, and a penetration portion that passes through at least one sheet of the pair of sheets in a thickness direction is formed in the steam discharge region of the at least one sheet, wherein the steam discharge seal portion has a tip end portion with a tip end point at a position closest to a center side of the accommodation space, and the penetration portion is locatable on a penetration-portion virtual line obtained by virtually connecting a center of the accommodation space and the tip end point, so that a portion of the penetration portion closest to the center side of the accommodation space is located on the penetration-portion virtual line.

2. The pouch according to claim 1, wherein the penetration portion is formed in both of the pair of sheets.

3. The pouch according to claim 1, wherein at least a part of the penetration portion is located closer to the accommodation space than an edge-portion-virtual line obtained by virtually extending an edge portion located closest to the side of the accommodation space among the first seal portion and the second seal portion.

4. The pouch according to claim 1, wherein a shape of the penetration portion when seen in the thickness direction is an arc shape curved toward a center of the accommodation space and the penetration portion having a first end point and a second end point.

5. The pouch according to claim 1 further comprising:

a first bottom seal portion; and a second bottom seal portion, wherein the bottom portion has a bottom sheet interposed between the pair of sheets and being folded in a V-shape in a side view, one side seal portion of the pair of side seal portions is a left side seal portion, and another is a right side seal portion, the left side seal portion and the right side seal portion are substantially linear and include a portion that joins the pair of sheets and a portion that joins facing surfaces of the bottom sheet that is folded, the first bottom seal portion is a portion that joins a first sheet of the pair of sheets and the bottom sheet, the first bottom seal portion includes a first left bottom side seal portion, a first right bottom side seal portion, and a first bottom intermediate seal portion that is substantially linear and continuously connected to the first left bottom side seal portion and the first right bottom side seal portion between the first left bottom side seal portion and the first right bottom side seal portion, the second bottom seal portion is a portion that joins a second sheet of the pair of sheets and the bottom sheet, the second bottom seal portion includes a second left bottom side seal portion, a second right bottom side seal portion, and a second bottom intermediate seal portion that is substantially linear and continuously connected to the second left bottom side seal portion and the second right bottom side seal portion between the second left bottom side seal portion and the second right bottom side seal portion, wherein a length A1 [mm] and a length A2 [mm] are equal, when the length A1 in a width direction from a lower end of an inner edge of a portion of the left side seal portion that joins the facing surfaces of the bottom sheet that is folded, to a virtual vertical line with respect to an outer edge of the first bottom intermediate seal portion or the second bottom intermediate seal portion, that includes a portion in which an inner edge of the first left bottom side seal portion or the second left bottom side seal portion continuously connected to the left side seal portion, and an inner edge of the first bottom intermediate seal portion or the second bottom intermediate seal portion continuously connected to the first left bottom side seal portion or the second left bottom side seal portion, intersect each other, and the length A2 in the width direction from a lower end of an inner edge of a portion of the right side seal portion that joins the facing surfaces of the bottom sheet that is folded, to a virtual vertical line with respect to the outer edge of the first bottom intermediate seal portion or the second bottom intermediate seal portion, that includes a portion in which an inner edge of the first right bottom side seal portion or the second right bottom side seal portion continuously connected to the right side seal portion, and the inner edge of the first bottom intermediate seal portion or the second bottom intermediate seal portion continuously connected to the first right bottom side seal portion or the second right bottom side seal portion, intersect each other, and a ratio of A1 to a length B to A2 is 1:1:1 to 1:3:1, with the length B being a length of the inner edge of the first bottom intermediate seal portion or the second bottom intermediate seal portion in the width direction.

6. The pouch according to claim 5, wherein, when C [mm] is a length in a height direction from a folded portion of the bottom sheet to the lower end of the bottom sheet, and D [mm] is a length of the first bottom intermediate seal portion or the second bottom intermediate seal portion having a substantially linear shape in the height direction, the A1, the B, the A2, the C, and the D satisfy Equation (1).

$$(A1+B+A2)\times 2 \geq (C-D)\times 3.14\times 2 \quad (1)$$

7. The pouch according to claim 6, wherein an opening guide portion is formed in a part of the left side seal portion or the right side seal portion, the opening guide portion is provided between the steam discharge seal portion and a folded portion of the bottom sheet, and when F [mm] is a length from the opening guide portion to the lower end of the bottom sheet in the height direction, the C and the F satisfy Equation (2).

$$C\times 2 \leq F \quad (2)$$

8. The pouch according to claim 5, wherein a length of the left side seal portion in the width direction and a length of the right side seal portion in the width direction are equal.

9. The pouch according to claim 5, wherein an opening guide portion is formed in a part of the left side seal portion or the right side seal portion, and the opening guide portion is provided between the steam discharge seal portion and a folded portion of the bottom sheet.

10. The pouch according to claim 1, wherein the steam discharge region is an unsealed region.

11. The pouch according to claim 1, wherein the steam discharge seal portion has a first connection portion and a second connection portion, the first connection portion connecting the tip end portion and the second seal portion, and extending in parallel to an outer edge of the top portion or the bottom portion, and the second connection portion connecting the tip end portion and the first seal portion.

12. The pouch according to claim 11, wherein the second connection portion is inclined with respect to a direction orthogonal to the outer edge, the second connection portion including a first portion and a second portion having different inclination angles with respect to the direction orthogonal to the outer edge.

13. The pouch according to claim 12, wherein a shape of the penetration portion when seen in the thickness direction is an arc shape curved toward a center of the accommodation space and the penetration portion having a first end point and a second end point.

14. The pouch according to claim 13, wherein a portion of the penetration portion closest to the center side of the accommodation space is located on the penetration-portion virtual line.

15. The pouch according to claim 11, wherein a shape of the penetration portion when seen in the thickness direction is an arc shape curved toward a center of the accommodation space.

16. The pouch according to claim 15, wherein a portion of the penetration portion closest to the center side of the accommodation space is located on the penetration-portion virtual line.

* * * * *